US010482710B2

(12) United States Patent
Yamaguchi

(10) Patent No.: US 10,482,710 B2
(45) Date of Patent: Nov. 19, 2019

(54) GAME MEDIUM EXCHANGE DEVICE

(71) Applicant: UNIVERSAL ENTERTAINMENT CORPORATION, Koto-Ku, Tokyo (JP)

(72) Inventor: Shinsuke Yamaguchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 140 days.

(21) Appl. No.: 15/093,996

(22) Filed: Apr. 8, 2016

(65) Prior Publication Data

US 2016/0307404 A1 Oct. 20, 2016

(30) Foreign Application Priority Data

Apr. 15, 2015 (JP) ..... 2015083628

(51) Int. Cl.
*G07F 17/32* (2006.01)

(52) U.S. Cl.
CPC ..... *G07F 17/3244* (2013.01); *G07F 17/3211* (2013.01)

(58) Field of Classification Search
CPC .. G07F 17/3211; G07F 17/3244; G07F 17/34; G07F 17/32
USPC ..... 463/25
See application file for complete search history.

(56) References Cited

U.S. PATENT DOCUMENTS 6,567,159 B1 * 5/2003 Corech ..... B07C 5/3422 250/559.4
2001/0034647 A1 * 10/2001 Marks ..... G06Q 30/02 705/14.14
2007/0026949 A1 * 2/2007 Charlier ..... G06K 19/07796 463/47
2008/0129504 A1 * 6/2008 Killian ..... G01T 7/00 340/572.1
2010/0285869 A1 * 11/2010 Walker ..... G07F 17/32 463/25
2012/0105215 A1 * 5/2012 Gronau ..... G07F 17/322 340/10.51
2014/0339107 A1 * 11/2014 Gelinotte ..... G07G 1/00 206/216

* cited by examiner

*Primary Examiner* — Jay Trent Liddle
*Assistant Examiner* — Ryan Hsu
(74) *Attorney, Agent, or Firm* — Simpson & Simpson, PLLC; S. Peter Konzel

(57) ABSTRACT

Time required for exchanging game media for another type of game media can be shortened. A game medium exchange device includes: a display device; an arranging mechanism configured to hold one or more convertible game media and one or more inconvertible game media in such a manner that the convertible game media and the inconvertible game media are arranged in their respective sections of the arranging mechanism; an information acquiring mechanism configured to acquire game medium information including the currency values of the convertible game media and the inconvertible game media arranged in the arranging mechanism; and a control device configured to obtain total amounts of the currency values of the convertible game media and the inconvertible game media acquired by the information acquiring mechanism, and to display these total amounts on the display device in association with the convertible game media and the inconvertible game media.

15 Claims, 20 Drawing Sheets

FIG.7

| GAME MEDIUM MANAGEMENT DATABASE | | |
|---|---|---|
| IDENTIFICATION INFORMATION (64-BIT UID) | GROUP CODE (10-BIT AFI) | LOG |
| ---------- | ---------- | ---------- |
| ---------- | ---------- | ---------- |
| ---------- | ---------- | ---------- |

FIG.8

FIRST GAME MEDIUM INFORMATION TABLE

| IDENTIFICATION INFORMATION | ATTRIBUTE | AMOUNT | DENOMINATION |
|---|---|---|---|
| ID001 | JUNKET NN | 100 | HKD |
| ID111 | JUNKET NN | 100 | HKD |
| ID123 | JUNKET NN | 100 | HKD |
| ID222 | JUNKET NN | 200 | PHP |
| ID337 | JUNKET CASH | 300 | HKD |
| ID021 | JUNKET CASH | 100 | PHP |
| ... | ... | ... | ... |
| ID173 | JUNKET NN | 100 | HKD |
| ID521 | JUNKET CASH | 100 | PHP |
| ID317 | JUNKET CASH | 300 | HKD |
| ID282 | JUNKET NN | 200 | PHP |
| ... | ... | ... | ... |

FIG.9

SECOND GAME MEDIUM INFORMATION TABLE

| IDENTIFICATION INFORMATION | ATTRIBUTE | AMOUNT | DENOMINATION |
|---|---|---|---|
| ID501 | JUNKET CASH | 100 | HKD |
| ID911 | JUNKET CASH | 100 | HKD |
| ID129 | JUNKET CASH | 100 | HKD |
| ID322 | JUNKET CASH | 100 | HKD |
| ID398 | JUNKET CASH | 100 | HKD |
| ID721 | JUNKET CASH | 100 | HKD |
| ... | ... | ... | ... |
| ID873 | JUNKET CASH | 100 | HKD |
| ID528 | JUNKET CASH | 100 | HKD |
| ID397 | JUNKET CASH | 300 | HKD |
| ID682 | JUNKET NN | 200 | HKD |
| ... | ... | ... | ... |

FIG.10

DISPLAY COLOR SETTING TABLE

| DENOMINATION | | ATTRIBUTE | DISPLAY COLOR |
|---|---|---|---|
| US DOLLAR | USD | CASH | A1 |
| | | JUNKET CASH | A2 |
| | | JUNKET NN | A3 |
| | | PREMIUM CASH | A4 |
| | | PREMIUM NN | A5 |
| | | OTHER | A6 |
| HONG KONG DOLLAR | HKD | CASH | B1 |
| | | JUNKET CASH | B2 |
| | | JUNKET NN | B3 |
| | | PREMIUM CASH | B4 |
| | | PREMIUM NN | B5 |
| | | OTHER | B6 |
| PHILIPPINE PESO | PHP | CASH | C1 |
| | | JUNKET CASH | C2 |
| | | JUNKET NN | C3 |
| | | PREMIUM CASH | C4 |
| | | PREMIUM NN | C5 |
| | | OTHER | C6 |
| CHINESE YUAN | CNY | ••• | ••• |
| THAI BAHT | THB | ••• | ••• |
| SINGAPORE DOLLAR | SGD | ••• | ••• |
| INDONESIAN RUPIA | IDR | ••• | ••• |
| MALAYSIAN RINGGIT | MYR | ••• | ••• |
| KOREAN WON | KRW | ••• | ••• |
| VIETNAMESE DONG | VND | ••• | ••• |
| CANADIAN DOLLAR | CAD | ••• | ••• |
| MEXICAN PESO | MXN | ••• | ••• |

FIG.15

| REGION | BLOCK REGION | DATA | DATA READING | DATA WRITING |
|---|---|---|---|---|
| USER REGION | 0～57 | Reserved for user | ○ | ○ |
| SYSTEM REGION | A | Reserved for future | ○ | × |
| | B | 64-BIT UID (IDENTIFICATION INFORMATION) | ○ | × |
| | C | | | |
| | D | 8-BIT DSFID (SECOND ERROR DETECTING CODE) 4-BIT AFI (GROUP CODE) etc. | ○ | △ |
| | E | Block security | ○ | × |
| | F | | | |

GAME MEDIUM EXCHANGE DEVICE

CROSS-REFERENCE TO RELATED APPLICATION

The present application claims priority from Japanese Patent Application No. 2015-083628, which was filed on Apr. 15, 2015, the disclosure of which is herein incorporated by reference in its entirety.

FIELD OF THE INVENTION

The present invention relates to a game medium exchange device which is used when exchanging a game medium such as a plaque or a chip used in a game for another type of game medium.

BACKGROUND OF THE INVENTION

In a game place such as a casino, the following system is adopted. A player exchanges currency (money) for one or more game media such as a casino chip and a plaque equivalent thereto, and plays a game such as roulette or poker using the game media. In the middle of the game or after the end of the game, the player exchanges the game media on hand for currency or another type of game media.

As a known device used when exchanging currency or game medium, for example, there is a portable reader described in Published Japanese Translation of PCT Application No. 2013-544005. The portable reader includes a housing having a currency reading surface; a shielded antenna disposed on the currency reading surface; and a display provided to the housing, and is configured to read information from RFID tags embedded within a plurality of gaming currencies placed on the currency reading surface, and display the total amount of the gaming currencies on the display.

Incidentally, for example, to exchange game media of one type for another type of game media by using the above-mentioned portable reader, the following process is needed: after the total amount of the currency values of the source gaming media is displayed on the display of the portable reader to check the amount, the total amount of the currency values of the target gaming media is displayed, to ensure that the total amount of the currency values of the source gaming media matches the total amount of the currency values of the target gaming media. Thus, the known device described above needs the operations of: displaying each of the total amounts of the source gaming media and the target gaming media; and checking whether these amounts match each other. This tends to take a long time before completing the exchange. As a result, the operating time of the game machine is reduced since the player has to wait during the time required for the exchange. For this reason, it is desirable to shorten the time required for the exchange.

Accordingly, an object of the present invention is to provide a game medium exchange device which can perform an exchanging operation in a short time when exchanging a game medium.

BRIEF SUMMARY OF THE INVENTION

An aspect of the present invention is a game medium exchange device for exchange between game media each having a currency value, including: a display device; an arranging mechanism configured to hold the game media in such a manner that the game media divided into groups are arranged in respective sections of the arranging mechanism; an information acquiring mechanism configured to acquire game medium information including the currency values of the game media arranged in the arranging mechanism; and a control device configured to obtain a total amount of the currency value acquired by the information acquiring mechanism for each of the sections in which the groups of the game media are respectively arranged in the arranging mechanism, and to display each total amount on the display device.

According to the above configuration, by displaying the total amount of the currency value on the display device for each of the sections in which with the groups of the game media are arranged in the arranging mechanism, it is possible to visually check and compare the total amounts of the currency values in the respective sections. Thereby, the groups of the game media separately arranged in the arranging mechanism can be exchanged with each other in a short time through an easy exchange operation.

The game media according to the present invention may include a convertible game medium exchangeable for currency, and an inconvertible game medium unexchangeable for currency.

According to the above configuration, by displaying the total amounts of the currency value on the display device in association with the convertible game medium and the inconvertible game medium, it is possible to visually check and compare the total amount of the convertible game medium and the total amount of the inconvertible game medium arranged in the arranging mechanism. Thereby, the convertible game medium and the inconvertible game medium separately arranged in the arranging mechanism can be exchanged with each other in a short time through an easy exchange operation.

The control device in the game medium exchange device of the present invention may identify a currency unit of each currency value based on the game medium information acquired by the information acquiring mechanism, and provide color-coding display with respect to the currency unit.

According to the above configuration, when visually checking the total amounts of the groups of the game media separately arranged in the arranging mechanism, these total amounts are displayed with color coding with respect to the currency unit of the game media, and therefore the game media can be exchanged in a further shorter period of time.

The control device in the game medium exchange device of the present invention may identify a type of each game medium based on the game medium information acquired by the information acquiring mechanism, and provide color-coding display with respect to the type of the game medium.

According to the above configuration, when visually checking the total amounts of the groups of the game media separately arranged in the arranging mechanism, there is provided the color-coding display with respect to the type of the game media. Thus, whether or not the game medium is the exchange object can be easily discriminated. Thereby, the game media can be exchanged in a further shorter period of time.

The game medium exchange device may be arranged such that: each game medium has a radio frequency identification tag capable of radio communicating the game medium information, the game medium exchange device contains the information acquiring mechanism, and the information acquiring mechanism obtains the game medium information by radio communication with the RFID tag of the game medium placed in the game medium exchange device.

According to the above configuration, since the game medium information of game medium can be easily acquired, the game media can be exchanged in a further shorter period of time.

The present invention enables short-time exchanging operation when exchanging the game medium.

BRIEF DESCRIPTION OF THE DRAWINGS

FIG. 7 is an explanatory drawing of a game medium management database.

FIG. 8 is an explanatory drawing of a first game medium information table.

FIG. 9 is an explanatory drawing of a second game medium information table.

FIG. 10 is an explanatory drawing of a display color setting table.

FIG. 15 is an explanatory drawing of a memory region in the RFID tag.

DETAILED DESCRIPTION OF THE PREFERRED EMBODIMENT

A game medium exchange device according to the present embodiment will be described with reference to the figures.

(Outline of Game Medium Exchange Device)

Figure 1:
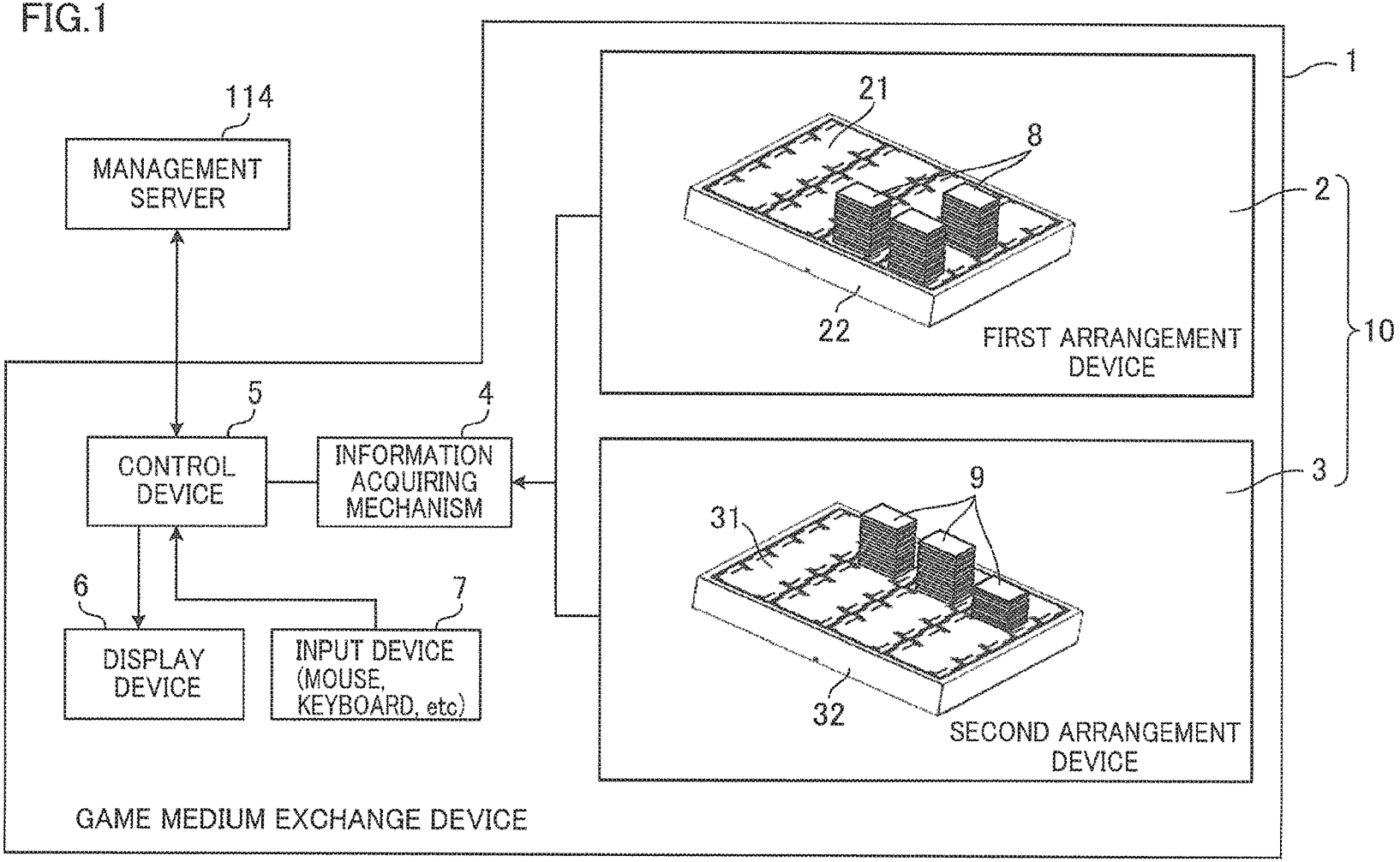
FIG. 1 is a block diagram showing a schematic configuration of a game medium exchange device.

As shown in FIG. 1, a game medium exchange device 1 is configured to improve the operability in exchanging a game medium having a currency value. Here, the "game medium", includes a convertible game medium 8 exchangeable for currency, and an inconvertible game medium 9 unexchangeable for currency. The "convertible game medium 8" and the "inconvertible game medium 9" each is a gaming value such as a medal, a token, and a plaque having a currency value including currency information and a game point in the form of electronic data or an exterior shape, and configured so that the currency value is readable from outside. The exterior shape is a shape identifiable from outside, for example, color, pattern, character, image, shape or the like. In addition, "exchange" includes both of the equivalent exchange and non-equivalent exchange.

Specifically, the game medium exchange device 1 has a display device 6, an information acquiring mechanism 4, an arranging mechanism 10, and a control device 5. The display device 6 employs a device which displays characters, image and/or video, such as a liquid crystal display, a plasma display, an organic EL display and the like. The arranging mechanism 10 is formed to be able to separately arrange one or more convertible game media 8 and one or more inconvertible game media 9.

The arranging mechanism 10 may include a first arrangement device 2 and a second arrangement device 3 mechanically separated from each other and respectively having separated arrangement surfaces 21*a* and 31*a*, to make the arranging mechanism 10 be partitioned to an arrangement region for the convertible game media 8 and an arrangement region for the inconvertible game media 9. Alternatively, the arranging mechanism 10 may include the first arrangement device 2 and second arrangement device 3 mechanically integrated with each other and may be partitioned by color coding or line to the arrangement region for the convertible game medium 8 and the arrangement region for the inconvertible game medium 9 on the same arrangement surface.

Further, the arrangement surfaces 21*a* and 31*a* each may be formed in a flat plate shape and the game media 8 and 9 may be arranged in the arranging mechanism 10 by placing the game media 8 and 9 on arrangement surfaces 21*a* and 31*a*, or the arrangement surfaces 21*a* and 31*a* may have recessed portions and the game media 8 and 9 may be accommodated in the recessed portions. In the configuration where the game media 8 and 9 are placed on the flat plate-shaped arrangement surfaces 21*a* and 31*a*, handling of the game media 8 and 9 at the time of exchange is easy. Meanwhile, in the configuration where the game media 8 and 9 are accommodated in the recessed portions of the arrangement surfaces 21*a* and 31*a*, it is easy to reduce the probability of occurrence of an error in reading the currency value since positioning of the game media 8 and 9 is easy.

The information acquiring mechanism 4 is configured to acquire the game medium information including the currency values of the game media 8 and 9 arranged in the arranging mechanism. The game medium information may be acquired through radio communication, i.e., by reading the game medium information stored in the memories of the game media 8 and 9 by radio communication, or through optical reading, i.e., by optically reading the game medium information incorporated in the exterior shape of the game media 8 and 9. The radio communication and the optical reading may be combined.

The control device 5 is configured to obtain the total amounts of the currency values of the one or more convertible game media 8 and the one or more inconvertible game media 9 acquired by the information acquiring mechanism 4, and to display these total amounts on the display device 6 in association with the convertible game medium 8 and the inconvertible game medium 9.

The game medium exchange device 1 configured as described above displays the total amounts of the currency values on the display device 6 in association with the convertible game media 8 and the inconvertible game media 9, and this makes it possible to visually check whether or not the total amount of the currency values of the convertible game media 8 in the arranging mechanism 10 is the same as the total amount of the currency values of the inconvertible game media 9 in the arranging mechanism 10. Thereby, the game medium exchange device 1 enables equivalent exchange between the convertible game media 8 and the inconvertible game media 9 separately arranged in the arranging mechanism 10 in a shorter period of time through an easy exchange operation.

The above description deals with a case of equivalent exchange between the convertible game media 8 and the inconvertible game media 9 functioning as the game media, but the present invention is not limited thereto.

That is, the game medium exchange device 1 is configured to be used for exchange between game media each having a currency value, and it is only required to include: the display device 6; the arranging mechanism 10 configured to hold the game media in such a manner that the game media divided into groups are arranged in respective sections; the information acquiring mechanism 4 configured to acquire game medium information including the currency value of each game medium arranged in the arranging mechanism 10; and the control device 5 configured to obtain the total amount of the currency value acquired by the information acquiring mechanism 4 for each of the section in which the groups of the game media are respectively arranged in the arranging mechanism 10, and to display each total amount on the display device 6. Thus, the total amounts of the currency values for the respective sections in which the groups of the game media are respectively arranged in the arranging mechanism 10 are displayed on the display device 6, and this makes it possible to visually check and compare the total amounts of the currency values of the respective sections. As a result, the groups of game media separately arranged in the arranging mechanism 10 can be exchanged with each other in a shorter period of time through an easy exchange operation.

Further, the control device 5 preferably displays a display screen for the first arrangement device 2 and a display screen for the second arrangement device 3 on the same screen of the display device 6, and displays the total amount of the currency values of the convertible game media 8 and the total amount of the currency values of the inconvertible game media 9 on their respective display screens. In this case, since the comparison of the total amounts of the currency values of the convertible game media 8 and the inconvertible game media 9 can be easily conducted on the two screens, the equivalent exchange of the game media 8 and 9 is able to be completed easily.

Further, the control device 5 is preferably configured to identify the currency unit of the currency values based on the game medium information acquired by the information acquiring mechanism 4, and to provide color-coding display with respect to the currency unit. With the thus configured game medium exchange device 1, when visually checking the total amounts of the groups of the game media such as the convertible game media 8 and the inconvertible game media 9 separately arranged in the arranging mechanism 10, exchange of the game media can be performed in a shorter period of time because the total amounts are displayed with color coding with respect to the currency unit.

Further, the control device 5 is configured to identify the type of various game media including the convertible game media 8 and the inconvertible game media 9, based on the game medium information acquired by the information acquiring mechanism 4, and to provide color-coding display with respect to the type of the game media. With the thus configured game medium exchange device 1, when visually checking the total amounts of the currency values of the groups of the game media separately arranged in the arranging mechanism 10, it is possible to easily determine whether the arranged game media are the game media 8 and 9 which are desired to be exchanged because of the color-coding with respect to the type of the game media. Thereby, with the game medium exchange device 1, it is possible to exchange the game media 8 and 9 in a further shorter period of time.

(Details of Game Medium Exchange Device)

The above-mentioned game medium exchange device 1 will be described specifically. Incidentally, in the following description, a case as follows will be described, but the present invention is not limited thereto: the convertible game medium 8 and the inconvertible game medium 9 are flat plate-shaped rectangular plaques; and the convertible game medium 8 and the inconvertible game medium 9 are equivalently exchanged in a configuration in which the arrangement region for the convertible game medium 8 and the arrangement region for the inconvertible game medium 9 are mechanically separated by the first arrangement device 2 and the second arrangement device 3.

(Game Medium Exchange Device: Arranging Mechanism 10)

The arranging mechanism 10 has the first arrangement device 2 and the second arrangement device 3. The first arrangement device 2 is set for the arrangement of a negotiable plaque as the convertible game medium 8. The second arrangement device 3 is set for the arrangement of a non-negotiable plaque as the inconvertible game medium 9. Incidentally, the first arrangement device 2 and the second arrangement device 3 may be set for the arrangement of any of the convertible game medium 8 and the inconvertible game medium 9 depending on various conditions such as the location. Therefore, the first arrangement device 2 may be set for the arrangement of the inconvertible game medium 9 and the second arrangement device 3 may be set for the arrangement of the convertible game medium 8.

(Game Medium Exchange Device: Arranging Mechanism 10: The First Arrangement Device 2)

Figure 2:
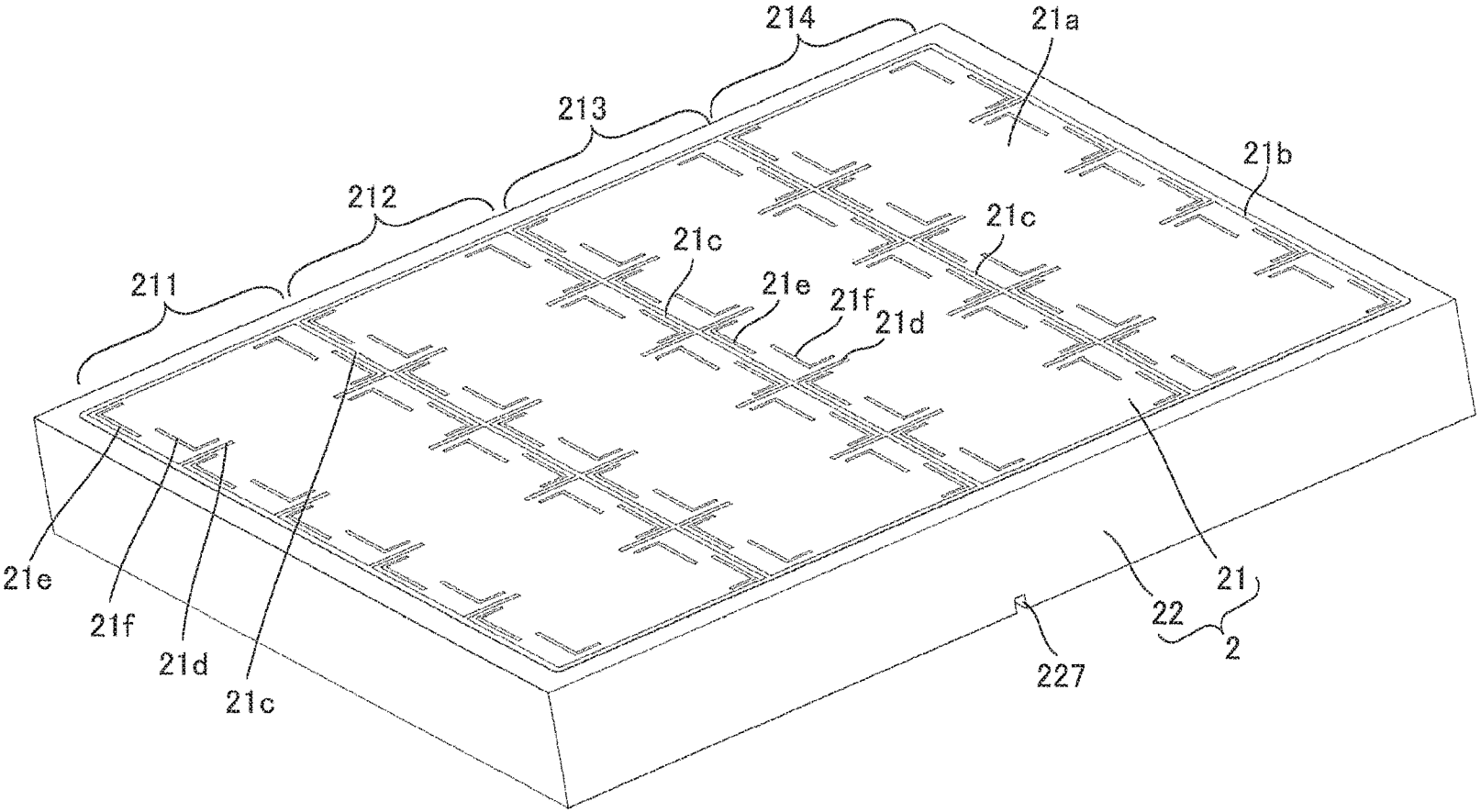
FIG. 2 is a perspective view of a first arrangement device.

As shown in FIG. 2, the first arrangement device 2 has a flat plate-shaped arrangement plate 21 disposed horizontally, and a frame body 22 having the arrangement plate 21 on the upper surface. The arrangement plate 21 has the arrangement surface 21*a* formed in a rectangular shape when viewed from the top. On the arrangement surface 21*a*, first to the fifth partitioning lines 21*b*, 21*c*, 21*d*, 21*e*, and 21*f* are denoted. The first to the fifth partitioning lines 21*b*, 21*c*, 21*d*, 21*e*, and 21*f* form placing regions visibly in a matrix form having five rows and four columns. These placing regions are capable of receiving three different sizes of convertible game media 8 placed in their respective prescribed positions.

Specifically, the first partitioning line 21*b* is formed in a rectangular shape along the periphery of the arrangement plate 21. The first partitioning line 21*b* is formed to have a size corresponding to that the size of large-sized convertible game media 8 placed in five rows and four columns. The region surrounded by the first partitioning line 21*b* is quadrisected by the second partitioning lines 21*c*. That is, the second partitioning lines 21*c* are arranged at an interval of the longitudinal length of the large-sized convertible game medium 8, so as to form regions each corresponding to one column of the large-sized convertible game media 8. In the following description, each region corresponding to one column and formed by the first partitioning line 21*b* and the second partitioning lines 21*c* is referred to as an information acquisition region, and the regions of the first column to the fourth column are referred to as the first to the fourth information acquisition regions 211 to 214.

In each of the first to the fourth information acquisition regions 211 to 214, the plurality of third partitioning lines 21*d* are formed. The third partitioning lines 21*d* are arranged at an interval of the width of the large-sized convertible game medium 8, so as to form a placing region of the large-sized convertible game medium 8. Further, in the placing regions surrounded by the third partitioning lines 21*d* in each of the first to the fourth information acquisition regions 211 to 214, the fourth partitioning lines 21*e* corresponding to the outer shape of the medium-sized convertible game medium 8 and the fifth partitioning lines 21*f* corresponding to the outer shape of the small-sized convertible game medium 8 are formed. The fourth partitioning lines 21*e* and the fifth partitioning lines 21*f* are formed so as to align the center points of the medium-sized and small-sized convertible game media 8 with the center point of the large-sized convertible game medium 8.

Figure 3:
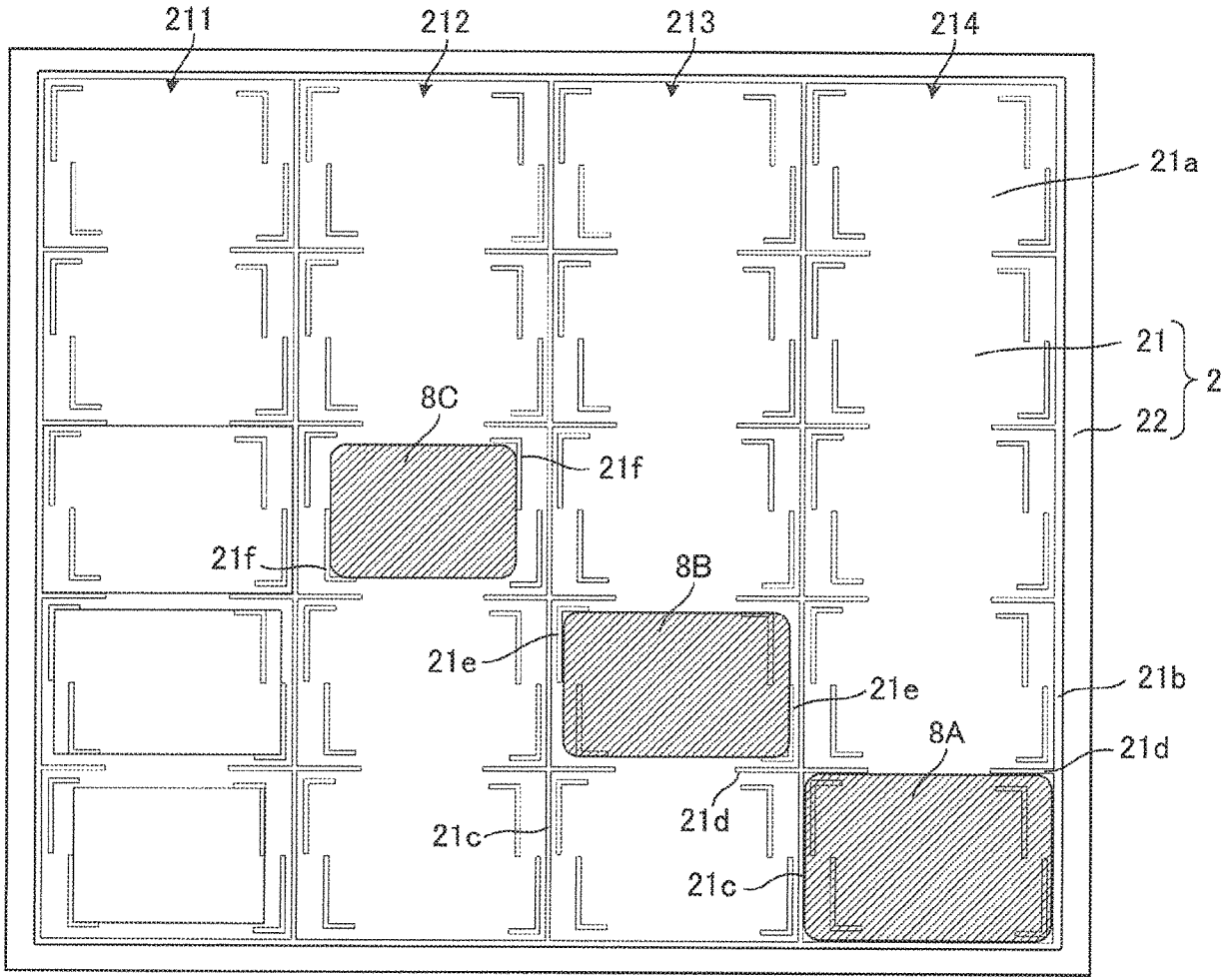
FIG. 3 is a plan view of the first arrangement device.

Thereby, as shown in FIG. 3, the game medium exchange device 1 makes it possible to do the alignment of the three different sizes of convertible game media 8 accurately by placing the gaming media while viewing the first to the fifth partitioning lines 21*b*, 21*c*, 21*d*, 21*e*, and 21*f* formed in the arrangement plate 21. That is, the large-sized convertible game media 8A can be accurately aligned by placing them to match the first partitioning line 21*b*, the second partitioning line 21*c* and the third partitioning line 21*d*. The medium-sized convertible game medium 8B can be accurately aligned by placing them to match the fourth partitioning lines 21*e*. The small-sized convertible game medium 8C can be accurately aligned by placing them to match the fifth partitioning lines 21*f*.

In the present embodiment, a case of dealing with three different sizes of convertible game media 8 has been described, but the present invention is not limited thereto. By increasing or decreasing the number of the partitioning lines in the first to the fourth information acquisition regions 211 to 214 in correspondence to the number of the size types of the convertible game media 8 to be dealt with, one or more size types of convertible game media 8 can be dealt with. Further, a case where the convertible game medium 8 is rectangular has been described in the present embodiment, but the present invention is not limited thereto. That is, by forming partitioning lines in correspondence to the shape and size of each convertible game medium 8 of round-shape or elliptical shape, convertible game media 8 of various shapes and various sizes can be dealt with.

Figure 4:
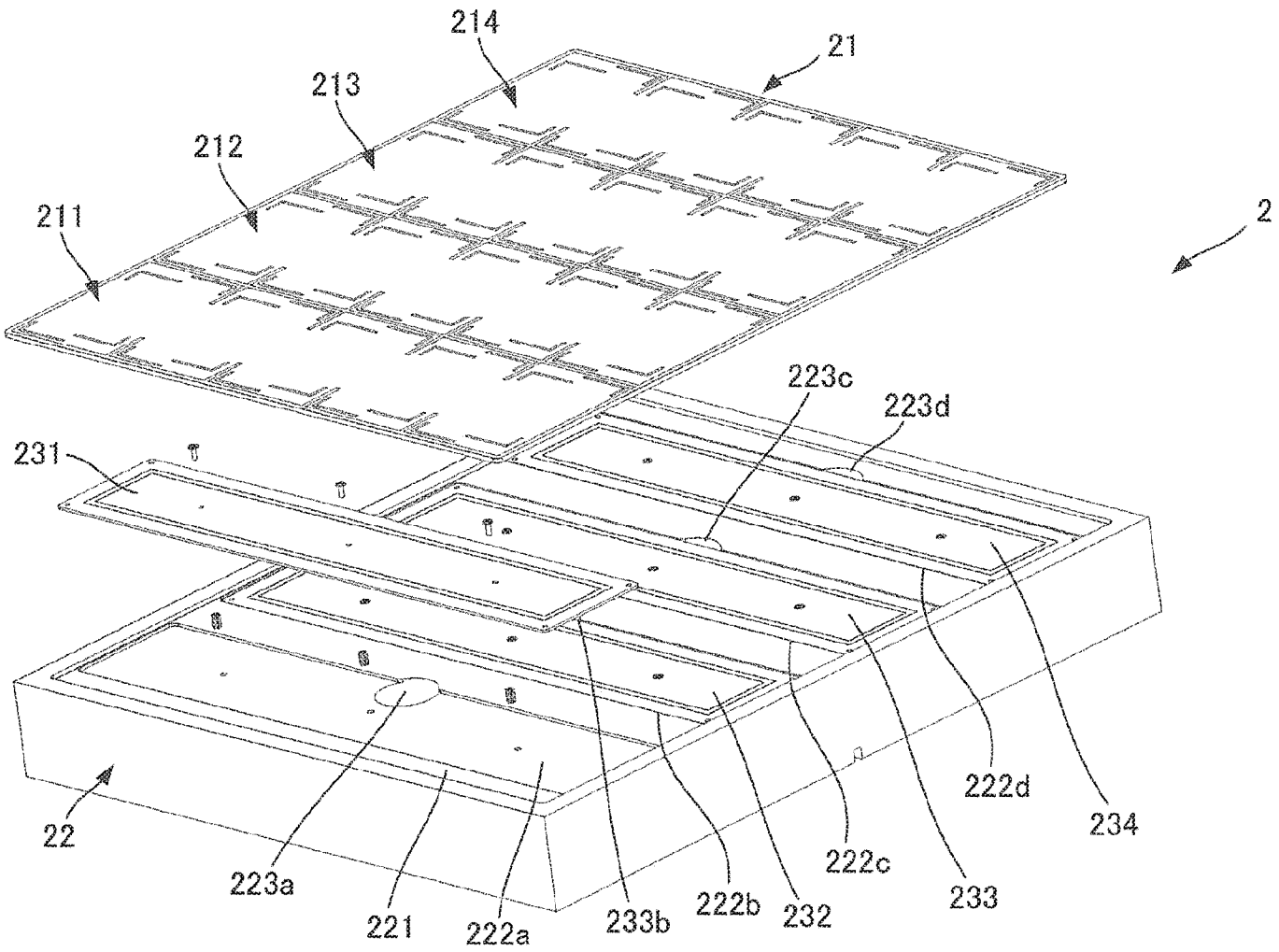
FIG. 4 is an exploded perspective view of the first arrangement device.

As shown in FIG. 4, four antenna boards 231 to 233 are disposed on the lower surface of the arrangement plate 21. The antenna boards 231 to 233 are disposed below the first to the fourth information acquisition regions 211 to 214 respectively, and are formed to substantially match the sizes and shapes of the first to the fourth information acquisition regions 211 to 214.

Each of the antenna boards 231 to 233 is set such that its communication range is within the corresponding one of the first to the fourth information acquisition regions 211 to 214 only. Thus, the first antenna board 231 is allowed to obtain only the game medium information of the convertible game media 8 placed in the first information acquisition region 211 by radio communication. The second antenna board 232 is allowed to obtain only the game medium information of the convertible game media 8 placed in the second information acquisition region 212 by radio communication. The third antenna board 233 is allowed to obtain only the game medium information of the convertible game media 8 placed in the third information acquisition region 213 by radio communication. The fourth antenna board 234 is allowed to obtain only the game medium information of the convertible game media 8 placed in the fourth information acquisition region 214 by radio communication.

The antenna boards 231 to 233 and the arrangement plate 21 are disposed on the upper surface portion of the frame body 22. The frame body 22 has a first recessed portion 221 and second recessed portions 222*a* to 222*d* in the upper surface portion. The first recessed portion 221 is formed to have a shape and size that can fit the arrangement plate 21, and has a depth same as the thickness of the arrangement plate 21. Thus, the upper surface of the frame body 22 is made flush with the arrangement plate 21 fitted in the first recessed portion 221.

Within the first recessed portion 221, the second recessed portions 222*a* to 222*d* are formed. Each of the second recessed portions 222*a* to 222*d* is formed to have a shape and size that can fit the antenna boards 231 to 233, respectively, and has a depth matching the thickness of the antenna boards 231 to 233. Thus, the upper surface of the first recessed portion 221 is made flush with the antenna boards 231 to 233 fitted in the second recessed portions 222*a* to 222*d*.

The second recessed portions 222*a* to 222*d* are disposed to be opposed to the first to the fourth information acquisition regions 211 to 214 of the arrangement plate 21 fitted in the first recessed portion 221, respectively. Thus, the antenna boards 231 to 233 can be respectively opposed, with high accuracy, to the first to the fourth information acquisition regions 211 to 214, by merely fitting the antenna boards 231 to 233 in the second recessed portions 222*a* to 222*d*.

Within the second recessed portions 222*a* to 222*d*, round-shaped holes 223*a* to 223*d* are formed respectively. A Portion of each of the holes 223*a* to 223*d* is formed in the upper surface of the first recessed portion 221. The holes 223*a* to 223*d* are set to have a diameter which allows a finger to be inserted thereinto. The holes 223*a* to 223*d* allow the manual operation with a finger to be performed easily when fixing the antenna boards 231 to 233 into the second recessed portions 222*a* to 222*d*, or removing the antenna boards 231 to 233 from the second recessed portions 222*a* to 222*d*.

Figure 5:
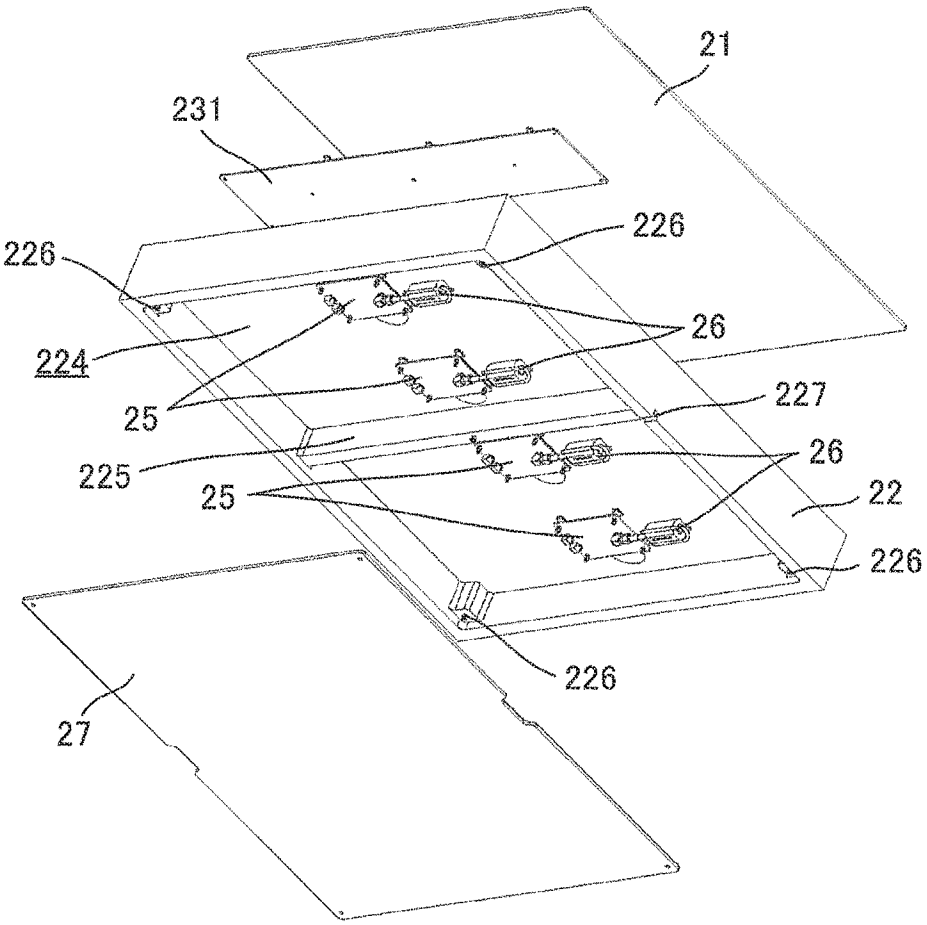
FIG. 5 is an exploded perspective view of the first arrangement device.

As shown in FIG. 5, the frame body 22 has an accommodation space 224 below the upper surface portion in which the first recessed portion 221 and the second recessed portions 222*a* to 222*d* are formed. Coupler boards 25 having antenna tuners for reducing the loss of radio wave, and ferrite cores 26 for reducing the high-frequency noise are provided in the accommodation space 224. The coupler boards 25 and the ferrite cores 26 are provided at four positions corresponding to the antenna boards 231 to 233 in FIG. 4. The coupler boards 25 are connected to the antenna boards 231 to 233 respectively. The signal line connecting each coupler board 25 to the corresponding one of the antenna boards 231 to 233 is inserted into the corresponding ferrite core 26. The ferrite core 26 reduces the noise mixed in the signal lines between the antenna board (231 to 233) and the coupler board 25.

In addition, a reinforcing plate 225 is provided at the center portion in the longitudinal direction in the accommodation space 224. The reinforcing plate 225 is formed throughout the width of the accommodation space 224, to enhance the rigidity of the frame body 22. Further, in the four corner portions of the accommodation space 224, screw fastening portions 226 are formed. The screw fastening portions 226 and the reinforcing plate 225 are formed to have bottom surfaces with the same height. A cover member 27 is abutted to the bottom surfaces of the screw fastening portions 226 and the reinforcing plate 225. Corner portions of the cover member 27 are screwed into the screw fastening portions 226.

Further, a groove portion 227 is formed in a center position of a side surface portion of the frame body 22. The groove portion 227 forms an air hole into which a signal line (not shown) is inserted. The air hole communicates the accommodation space 224 with the outside, when the bottom surface of the accommodation space 224 is closed by the cover member 27 attached to the frame body 22. Thus, in the game medium exchange device 1, an air passage within the accommodation space 224 is secured, and this prevents the malfunction due to the excessive temperature rising caused by the coupler board 25 and the ferrite core 26 provided within the accommodation space 224.

(Game Medium Exchange Device: Arranging Mechanism 10: The Second Arrangement Device 3)

As shown in FIG. 1, the second arrangement device 3 has the same members and the same configuration as the first arrangement device 2. That is, the second arrangement device 3 has an arrangement plate 31 and a frame body 32 of the same configuration as the arrangement plate 21 and the frame body 22 of the first arrangement device 2. Since other configurations in the second arrangement device 3 are the same as those of the first arrangement device 2, the description thereof will be omitted.

(Game Medium Exchange Device: Information Acquiring Mechanism 4)

Figure 6:
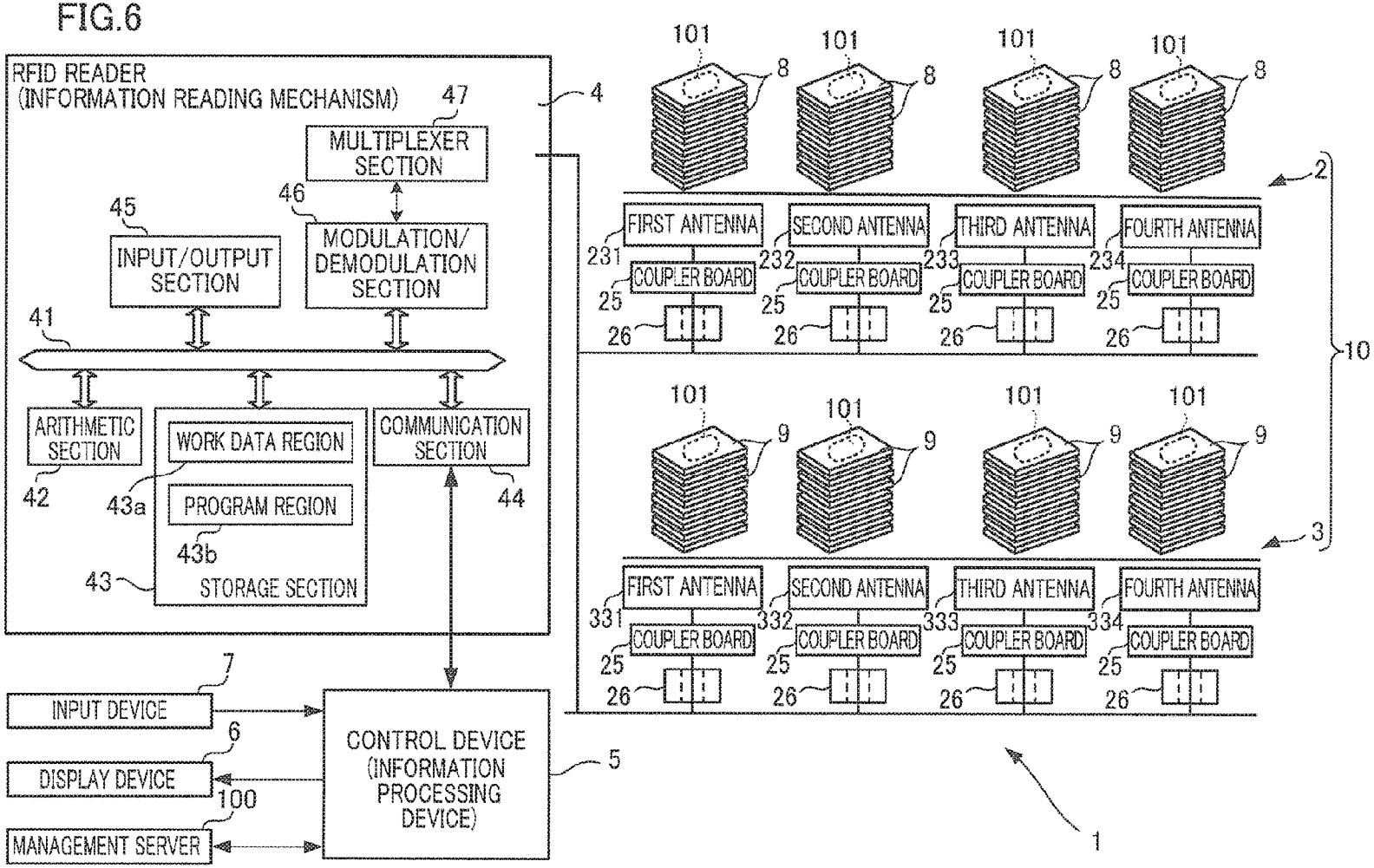
FIG. 6 is an explanatory drawing showing an electrical configuration of the game medium exchange device.

As shown in FIG. 6, the information acquiring mechanism 4 is constituted by a RFID (Radio Frequency IDentification) reader. The information acquiring mechanism 4 is configured to acquire the game medium information including the currency values of the game media 8 and 9 arranged in the first arrangement device 2 and the second arrangement device 3, respectively.

Specifically, the information acquiring mechanism 4 has an arithmetic section 42, a storage section 43, a communication section 44, an input/output section 45, and a modulation/demodulation section 46 connected to allow various data to be input and output bi-directionally via a signal bus 41. The input/output section 45 is configured to be connected to various sensors, operation buttons, and/or driving mechanisms not shown in the figure. The communication section 44 is connected to the control device 5 to allow data communication. The modulation/demodulation section 46 is connected to the antenna boards 231 to 233 of first arrangement device 2 and the antenna boards 331 to 333 of the second arrangement device 3 via a multiplexer section 47. The multiplexer section 47 has a switch circuit, and connects the modulation/demodulation section 46 with each of the antenna boards 231 to 233 and 331 to 333 switchably.

The modulation/demodulation section 46 has a modulation function of converting data from a signal form suitable for information processing to a signal form suitable for data communication via the antenna boards 231 to 233 and 331 to 333, and has a demodulation function of converting data from the signal form of data communication to the signal form of information processing.

Further, the storage section 43 has a work data region 43*a* and a program region 43*b*. The work data region 43*a* is used, for example, as a game medium management database temporarily storing the game medium information obtained from the game media 8 and 9.

As shown in FIG. 7, the game medium management database stores the identification information of the game media 8 and 9 (RFID tag 101) and the group code. In the present embodiment, the identification information of the game media 8 and 9 is a 64-bit UID (Unique IDentifier) of the RFID tag 101. The group code is an 8-bit AFI (Application Family Identifier) of the RFID tag 101. Further, in the game medium management database 35 of the present embodiment, a DSFID (Data Storage Format Identifier) may be stored. The information acquiring mechanism 4 reads data from a plurality of game media 8 and 9 by a stochastic method of RFID technology. Accordingly, the information acquiring mechanism 4 is unnecessary to compare the intrinsic identification information of the game media 8 and 9 when recognizing the game media 8 and 9 by a first error detecting code and a second error detecting code.

As shown in FIG. 6, the program region 43*b* stores various programs such as a reading process routine for reading the game medium information from the game media 8 and 9. The various programs such as the reading process routine can be executed in the arithmetic section 42. The reading process routine is configured to read the game medium information of the game media 8 and 9 in units of the information acquisition regions 211 to 214 and 311 to 314 of the first arrangement device 2 and the second arrangement device 3. Accordingly, as compared with the case where the game medium information of all the game media 8 and 9 arranged in the information acquisition regions 211 to 214 and 311 to 314 are read collectively, the time required for such as check read or reread is reduced because reading is performed separately, and therefore the game medium information can be read in a short time. The game medium information reading process including such as a check read will be detailed later.

(Game Medium Exchange Device: Control Device 5)

The control device 5 is constituted by an information processing device such as a personal computer. The control device 5 is connected to a display device 6 and an input device 7. Further, the control device 5 is connected data-communicably to a management server 100 via a communication line or a communication network. The management server 100 is adapted to perform an operation status management of the game medium exchange device 1 and a comprehensive management of the game media 8 and 9.

The control device 5 has a storage section for storing data in a storage form of various data tables such as the first game medium information table of FIG. 8, the second game medium information table of FIG. 9, or the display color setting table of FIG. 10.

(Game Medium Exchange Device: Control Device 5: The First Game Medium Information Table)

As shown in FIG. 8, the first game medium information table is a data table for storing the game medium information of various game media arranged in the first arrangement device 2. Specifically, the first game medium information table has identification information column, an attribute column, an amount column, and a denomination column, and stores the game medium information of all the game media arranged in the first to the fourth information acquisition regions 211 to 214 of the first arrangement device 2.

For example, identification information "ID501", an attribute "junket cash", an amount "100", and a denomination "HKD (Hong Kong dollar)" are stored in the first row. This indicates that a convertible game medium 8 with identification information "ID501" having a currency value of 100 HKD is present in the first arrangement device 2. Further, identification information "ID721", an attribute "junket cash", an amount "100", and a denomination "HKD (Hong Kong dollar)" are stored in the sixth row. This indicates that a convertible game medium 8 with identification information "ID721" having a currency value of 100 HKD is present in the first arrangement device 2.

(Game Medium Exchange Device: Control Device 5: The Second Game Medium Information Table)

As shown in FIG. 9, the second game medium information table is a data table for storing the game medium information of various game media arranged in the second arrangement device 3. Specifically, the second game medium information table has identification information column, an attribute column, an amount column, and a denomination column, and stores the game medium information of all the game media arranged in the first to the fourth information acquisition regions 311 to 314 of the second arrangement device 3.

For example, identification information "ID001", an attribute "junket NN", an amount "100", and a denomination "HKD (Hong Kong dollar)" are stored in the first row. This indicates that an inconvertible game medium 9 with identification information "ID001" having a currency value of 100 HKD is present in the second arrangement device 3. In addition, identification information "ID021", an attribute "junket cash", an amount "100", and a denomination "PHP (Philippine peso)" are stored in the sixth row. This indicates that a convertible game medium 8 with identification information "ID021" having a currency value of 100 PHP is present in the second arrangement device 3.

(Game Medium Exchange Device: Control Device 5: The Second Game Medium Information Table)

As shown in FIG. 10, the display color setting table has a denomination column, an attribute column, and a display color column. The denomination column stores the denomination data of currency of each country and each region such as US dollar (USD), Hong Kong dollar (HKD), and Philippine peso (PHP). The attribute column stores the attributes of each denomination.

For example, as the attributes, there are "cash", "junket cash", "junket NN", "premium cash", "premium NN" and the like. Here, "cash" refers to the convertible game medium 8 issued to the player by the game place side. "Junket cash" refers to the convertible game medium 8 issued to the player by the junket side. "Junket NN" refers to the inconvertible game medium 9 issued to the player by the junket. "Premium cash" refers to the convertible game medium 8 issued to the important player by the game place side. "Premium NN" refers to the inconvertible game medium 9 issued to the important player by the game place side.

The display color column is set to be different display colors A1, A2, etc., in correspondence to the attributes of the denominations, respectively. For example, in US dollar (USD), the attribute of "cash" is displayed in display color A1, and the attribute of "junket cash" is displayed in display color A2.

Figure 16:
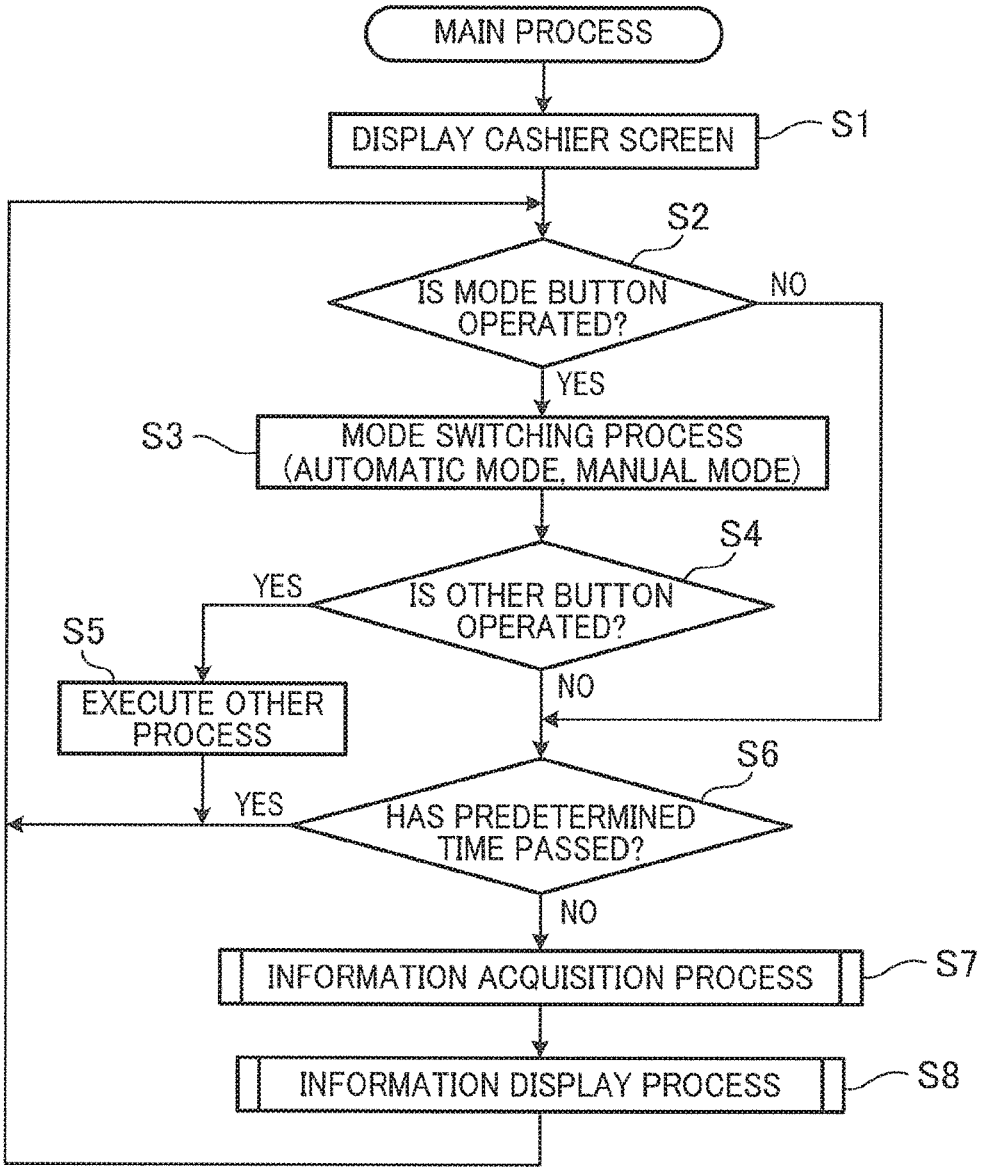
FIG. 16 is a flowchart of a main process.
Figure 18:
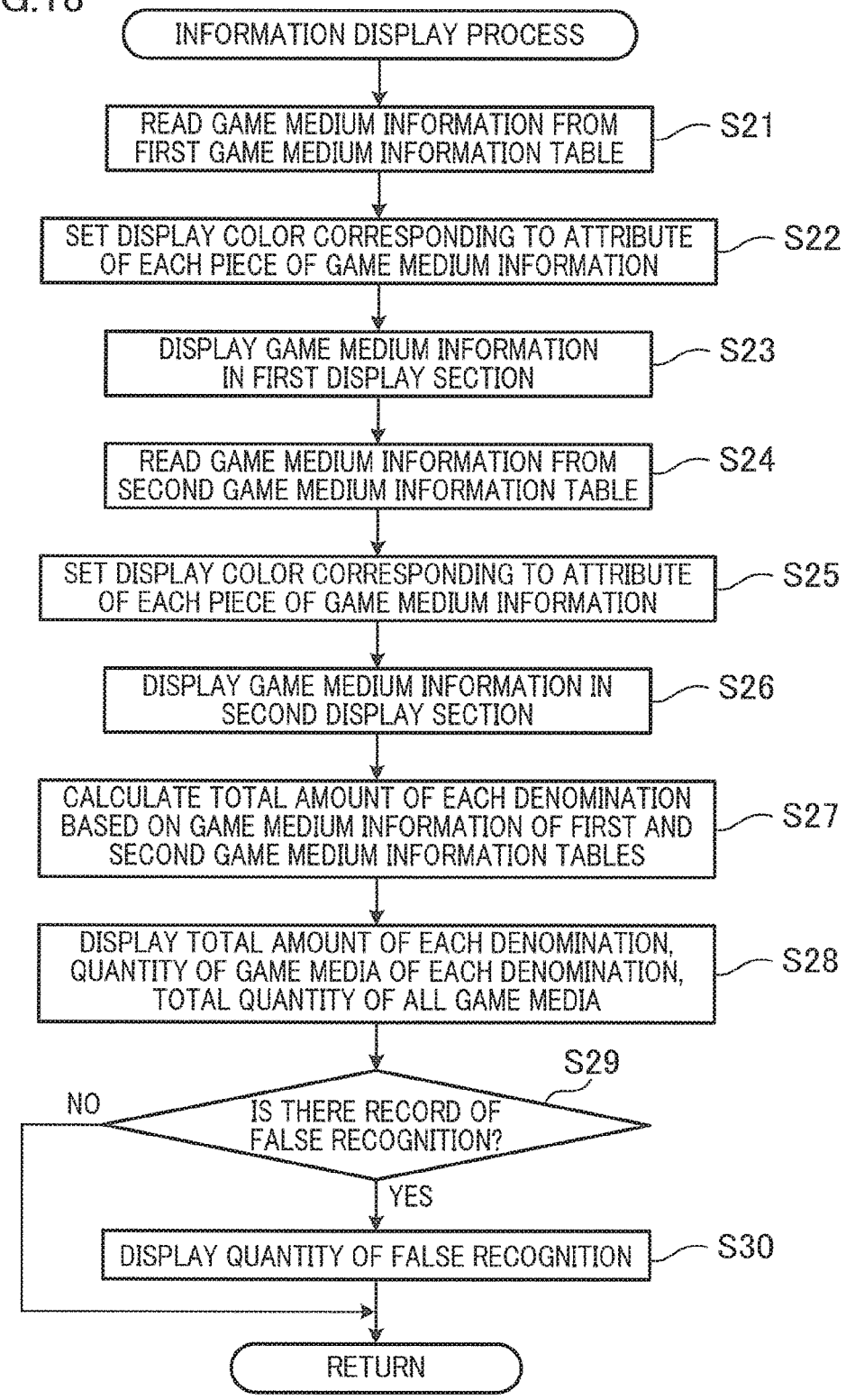
FIG. 18 is a flowchart of an information display process.

As shown in FIG. 6, the control device 5 is adapted to execute various process routines, such as the main process of FIG. 16 and the information display process of FIG. 18. Accordingly, by executing the main process or the information display process, the control device 5 is able to execute the process of obtaining the total amount of the currency values of the game media arranged in the first arrangement device 2 based on the first game medium information table of FIG. 8 and the process of obtaining the total amount of the currency values of the game media arranged in the second arrangement device 3 based on the second game medium information table of FIG. 9, and then comparably display these total amounts on the same screen of the display device 6 in association with the game media 8 and 9. Further, the control device 5 is adapted to display information with color coding with respect to the currency unit and the type of the game media based on the display color setting table of FIG. 10. Hereafter, the display state on the display device 6 will be described specifically.

(Game Medium Exchange Device: Display State of Display Device 6)

Figure 11:
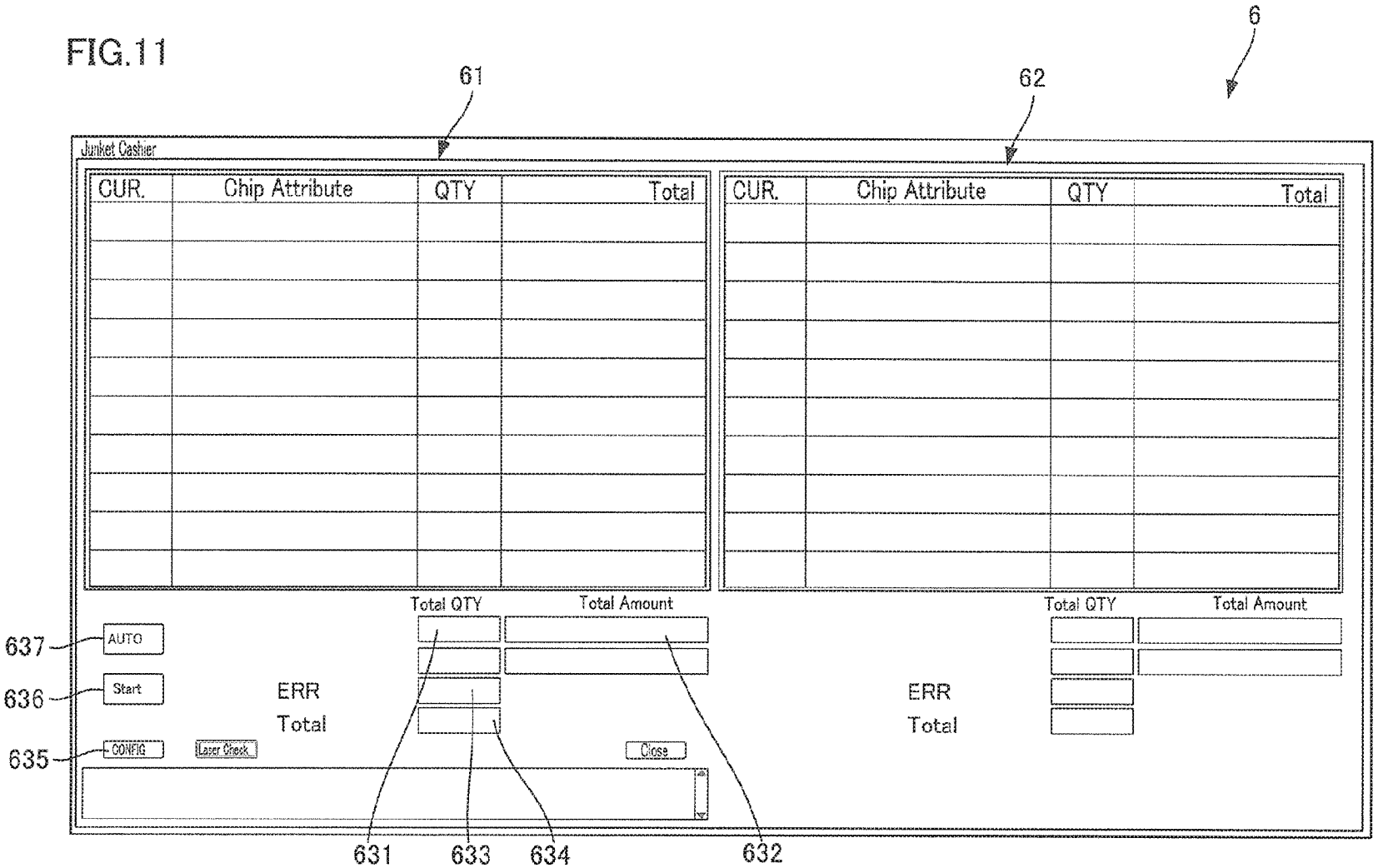
FIG. 11 is an explanatory drawing showing a display state of a display device.

As shown in FIG. 11, the display device 6 is configured to display a display screen including a left display section 61 arranged in the right region of the upper portion of the screen, a right display section 62 arranged in the left region of the upper portion of the scree, and a lower display section 63 arranged below the left display section 61 and the right display section 62. The left display section 61 displays the game medium information of the game medium arranged in the first arrangement device 2. The left display section 62 displays the game medium information of the game medium arranged in the second arrangement device 3.

In the upper portions of the left display section 61 and the right display section 62, display items of denomination "CUR." of the game medium, attribute "Chip Attribute" of the game medium, quantity "QTY" of the game medium, and amount "Total" obtained by multiplying the denomination and the quantity are arranged horizontally, and the game medium information of the game media of the first arrangement device 2 and the second arrangement device 3 is displayed below these display items.

In the lower display section 63 below the left display section 61, a denomination quantity section 631*a*, a denomination amount section 632*a*, an error section 633*a*, and a total amount section 634*a* are provided. The denomination quantity section 631*a* displays the quantity for each denomination of the game media arranged in the first arrangement device 2. The denomination amount section 632*a* displays the total amount for each denomination of the game media arranged in the first arrangement device 2. The error section 633*a* displays the quantity of error game media 8 having ineligible game medium information as a game medium. The total amount section 634*a* displays the total amount of all the game media arranged in the first arrangement device 2. A denomination quantity section 631*b*, a denomination amount section 632*b*, an error section 633*b*, and a total amount section 634*b* respectively having the same functions as those of the sections 631*a* to 634*a* are also provided below the right display section 62 and these display the information related to game media arranged in the second arrangement device 3.

Further, in the lower display section 63, a CONFIG button 635, a start button 636, and a mode button 637 are provided. The CONFIG button 635 allows shifting to the CONFIG screen, to perform the initial setting. The start button 636 is a button for giving the instruction of starting the acquisition of game medium information in the manual mode. The mode button 637 is a toggle switch for shifting the operating mode between the manual mode and the automatic mode. In the automatic mode, the latest game medium information in the first arrangement device 2 and the second arrangement device 3 is acquired at a predetermined time interval.

Figure 12:
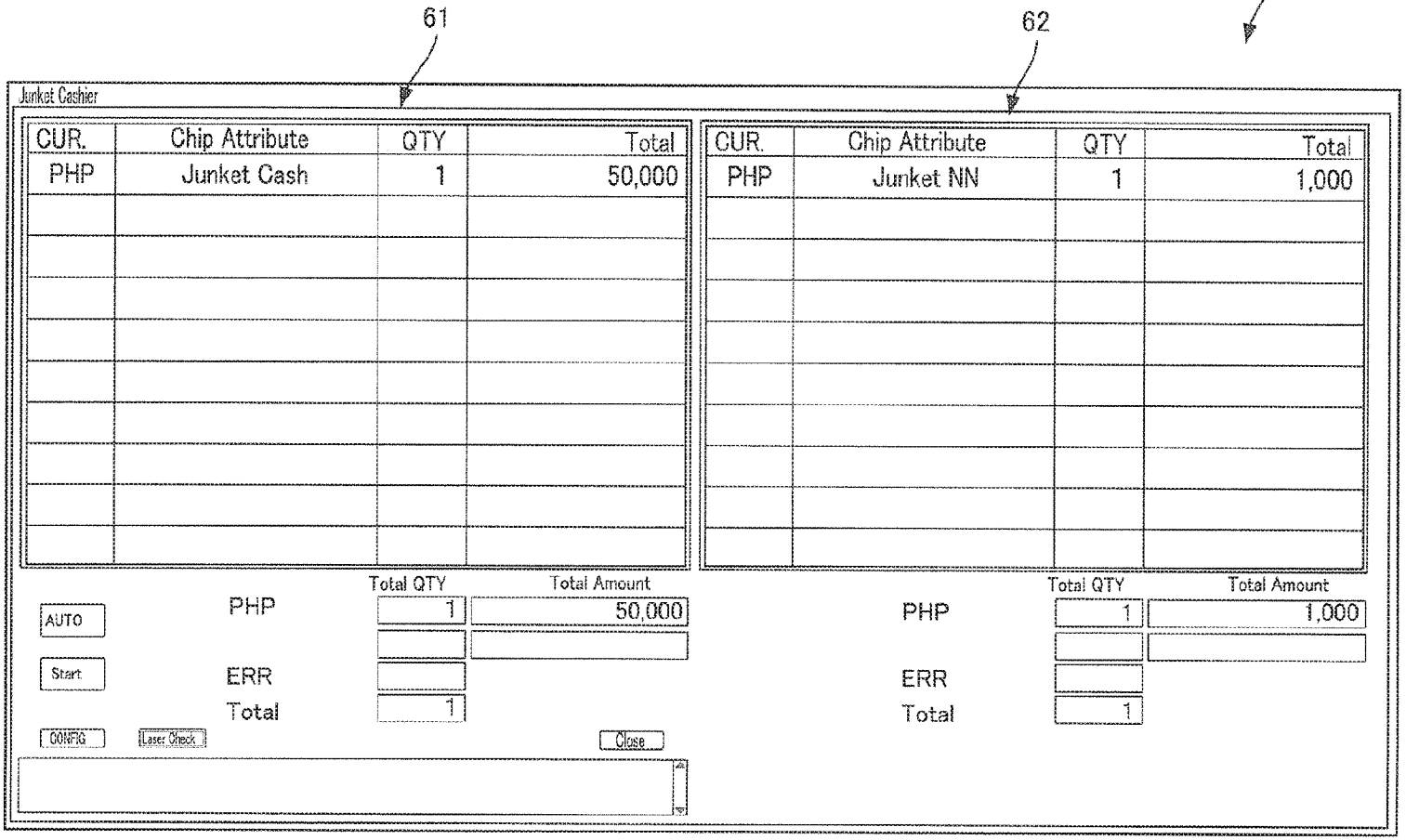
FIG. 12 is an explanatory drawing showing a display state of the display device.

FIG. 12 is one example of the display state, when the convertible game medium 8 of one junket cash is placed in the first arrangement device 2 and the inconvertible game medium 9 of one junket NN is placed in the second arrangement device 3. In this case, in the left display section 61 of the display device 6, "PHP" is displayed as the denomination of the game medium, "Junket Cash" is displayed as the attribute of the game medium, "1" is displayed as the quantity of the game medium, and "50000" is displayed as the amount obtained by multiplying the denomination and the quantity. Further, in the right display section 62 of the display device 6, "PHP" is displayed as the denomination of the game medium, "Junket NN" is displayed as the attribute of the game medium, "1" is displayed as the quantity of the game medium, and "1000" is displayed as the amount obtained by multiplying the denomination and the quantity.

Figure 13:
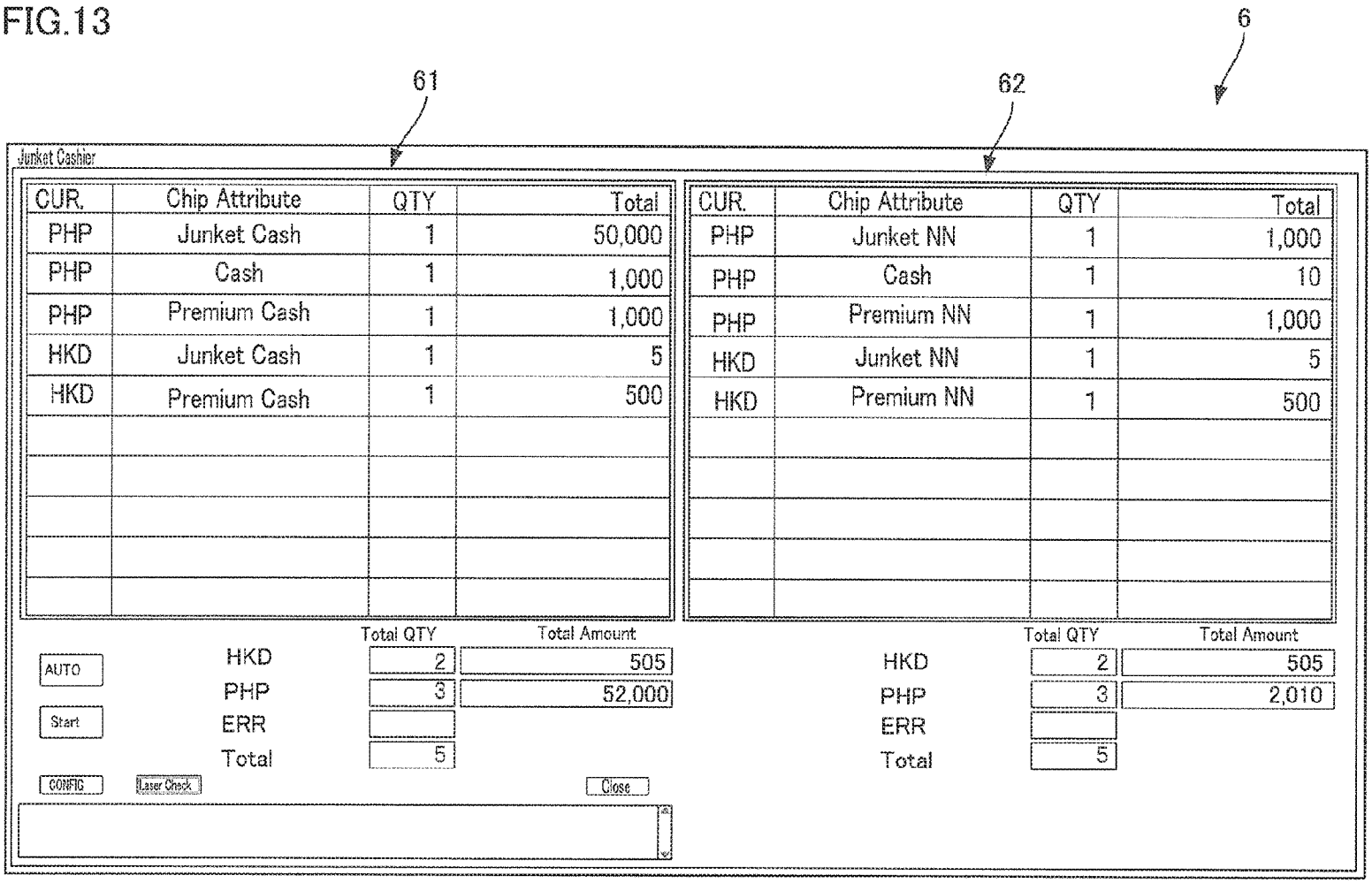
FIG. 13 is an explanatory drawing showing a display state of the display device.

FIG. 13 is one example of the display state, when various convertible game media 8 and inconvertible game media 9 are placed in the first arrangement device 2 and the second arrangement device 3, respectively. In this case, in the left display section 61 and the right display section 62 of the display device 6, the denomination of the game medium, the attribute of the game medium, the quantity of the game medium, and the amount obtained by multiplying the denomination and the quantity are displayed respectively, and these items are displayed with color coding with respect to the type.

(Convertible Game Medium 8 and Inconvertible Game Medium 9)

Figure 14:
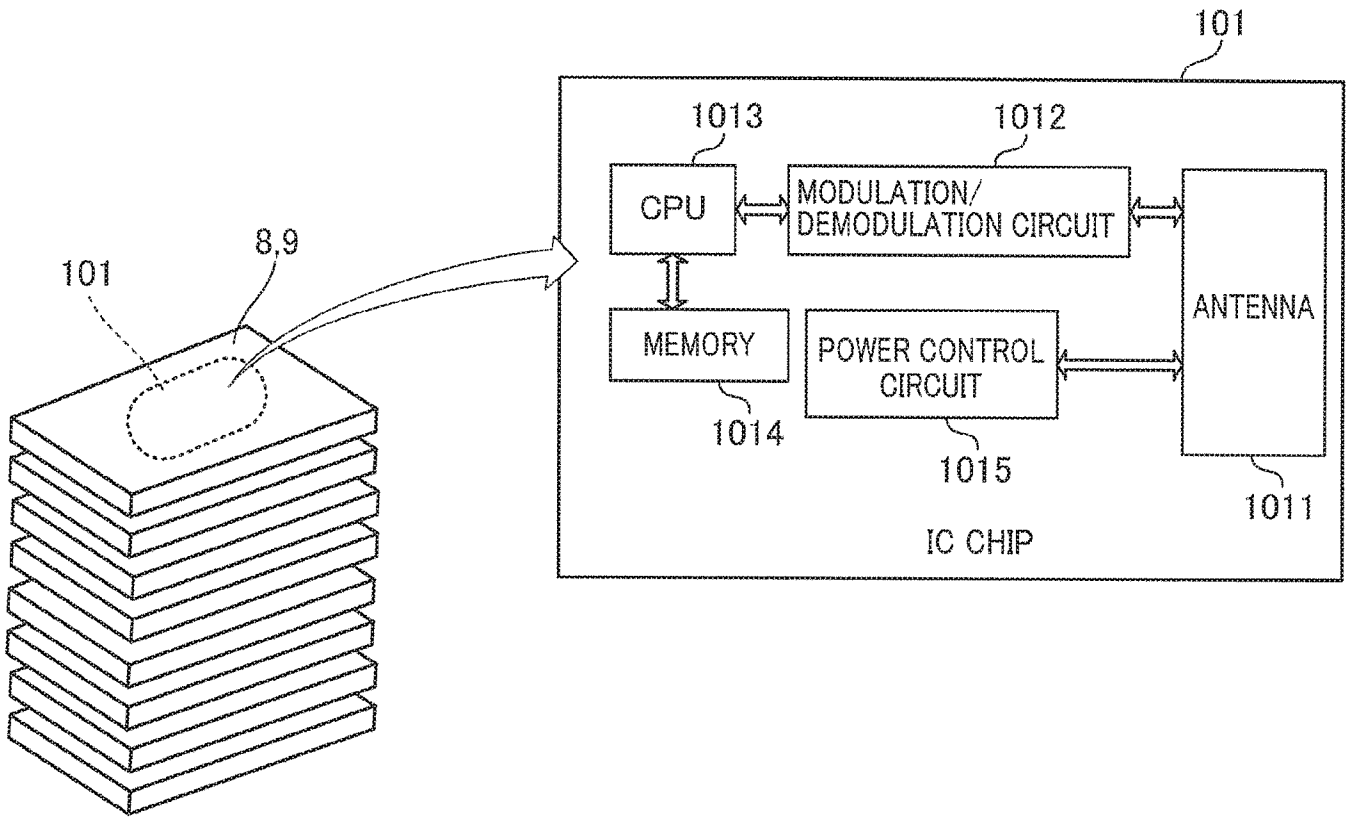
FIG. 14 is an explanatory drawing showing an electrical configuration of a RFID tag.

As shown in FIG. 14, the game media 8 and 9 are storage media to be exchanged instead of cash between a dealer and player in the game arcade such as a casino. The game media 8 and 9 are generally made of resin or the like. The game media 8 and 9 contain RFID tags 101 which are IC chips used for RFID.

The RFID tag 101 includes an antenna 1011, a modulation/demodulation circuit 1012, a CPU 1013, a memory 1014, and a power control circuit 1015. The memory 1014 stores various types of information such as identification information. The CPU 1013 interprets a command, request, instruction, and the like issued by the information acquiring mechanism 4 of FIG. 6, and performs an operation corresponding thereto. The modulation/demodulation circuit 1012 performs modulation/demodulation of signals to transmit/receive the game medium information such as identification information by radio with the information acquiring mechanism 4.

The antenna 1011 is a so-called loop antenna, which is formed by a conducting wire formed in an annular shape (loop shape). The antenna 1011 generates an induced current by a transmitted magnetic field, so that the induced current is used as a driving power of the RFID tag 101 via the power control circuit 1015.

As shown in FIG. 15, the memory 1014 is formed of a nonvolatile RAM storing the game medium information, and for example has a memory region of 256 bytes. The memory region of 256 bytes is divided into 64 blocks of 4 bytes each. Among the 64 blocks, 58 blocks are allocated to a user region (block numbers 0 to 57), and 6 blocks are allocated to a system region (block numbers A to F). That is, the storage section 43 includes a user region and a system region. The user region is a region that can be accessed by designation of a block address. The system region is a region that can be accessed by a predetermined command only.

Among the system regions A to F, the block A is a region for the future. In the block B and block C, a 64-bit UID is stored. In the block D, such as DSFID, AFI are stored. In the present embodiment, DSFID is a one-byte data generated by CRC (Cyclic Redundancy Check) from the UID. It should be noted that the CRC used herein means the CRC function, and a value generated by the CRC function is referred to as a CRC code. That is, DSFID is a one-byte CRC code. DSFID is a second error detecting code. AFI is a group code. In the block E and block F, data in the block security state is stored. The details of the reading process of reading the game medium information by using the data of each region of the memory 1014 will be describe later.

(Game Medium Exchange Device: Operation)

The operation of the game medium exchange device 1 constituted as the above will be described based on the flowchart. In the following description, the game medium exchange device 1 will be described on the assumption that the power source is supplied.

(Game Medium Exchange Device: Control Device 5: Main Process)

As shown in FIG. 16, in the control device 5, various processes are executed by the main process routine. Specifically, first, the cashier screen in FIG. 11 is displayed (S1). Then, whether or not the mode button 637 in the cashier screen has been operated is determined (S2). If the automatic button 637 is not operated (S2: NO), whether or not a predetermined time has passed as the standby time for the button operation is determined (S3). On the other hand, if the automatic button 637 has been operated (S2: YES), a mode switching process is executed, and the mode is switched to the automatic mode or the manual mode. That is, if the operation is in the automatic mode, the mode is switched to the manual mode. If the operation is in the manual mode, the mode is switched to the automatic mode (S3).

Then, whether or not another button has been operated is determined (S4). If another button has been operated (S4: YES), after the process corresponding to the function of the operated button is executed (S5), re-execution from S2 is performed. On the other hand, if other button is not operated (S4: NO), whether or not a predetermined time has passed as the standby time for the button operation is determined (S6). If the predetermined time has not passed (S6: NO), re-execution from S2 is performed. On the other hand, if the predetermined time has passed (S6: YES), an information acquisition process for acquiring the game medium information from the information acquiring mechanism 4 in FIG. 4 is executed (S7). Thereafter, an information display process for updating a cashier screen (see FIG. 12 and FIG. 13) is executed based on the acquired game medium information (S8).

(Game Medium Exchange Device: Control Device 5: Information Acquisition Process)

Figure 17:
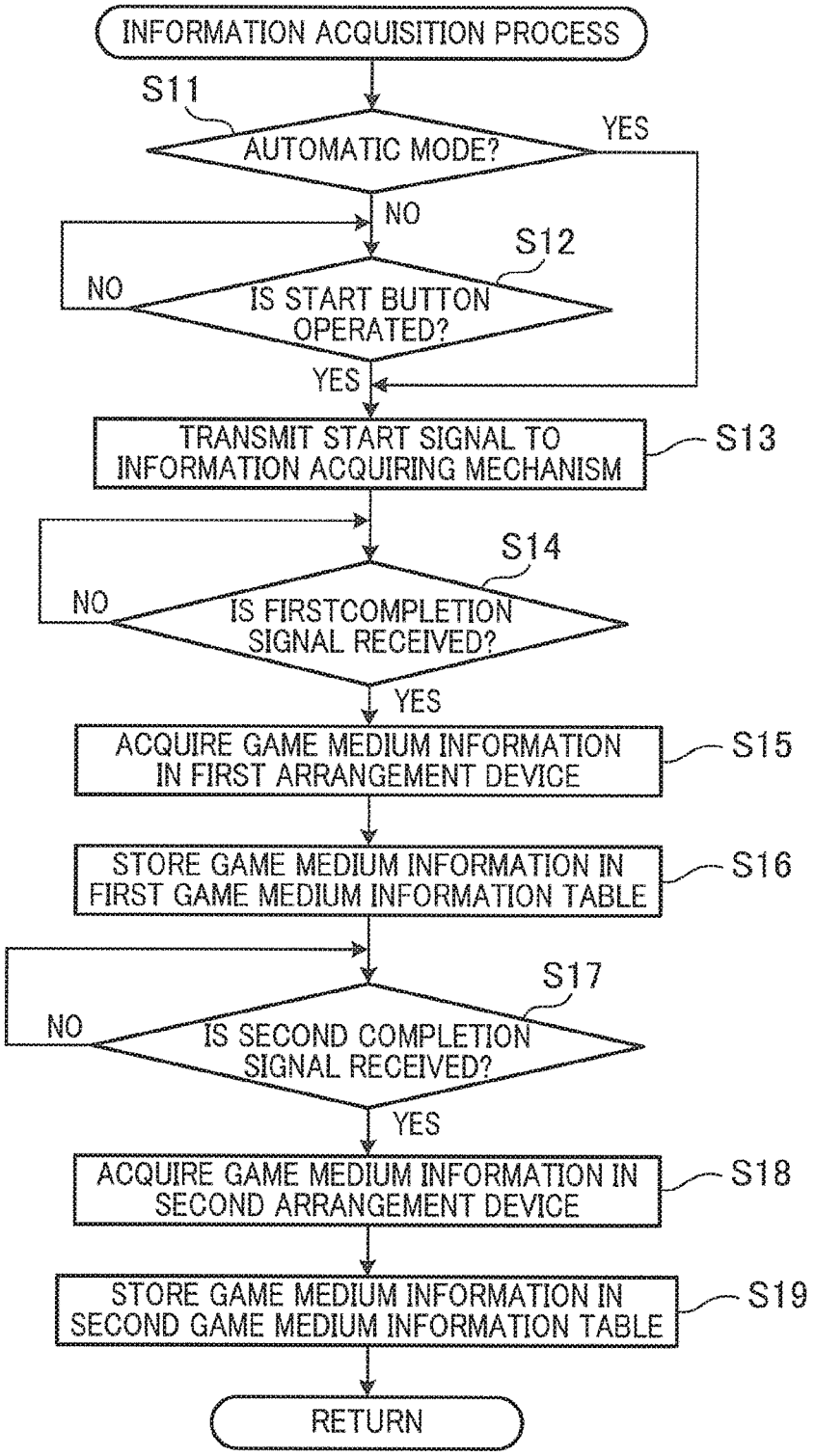
FIG. 17 is a flowchart of an information acquisition process.

As shown in FIG. 17, when the information acquisition process is executed in the main process, first, whether or not it is the automatic mode is determined (S11). If it is the automatic mode (S11: YES), a start signal is transmitted to the information acquiring mechanism 4 (S13). On the other hand, if it is not in the automatic mode (S11: NO), whether or not the start button 636 has been operated is determined (S12). If the start button 636 is not operated (S12: NO), by re-executing S12, it is in standby state until being operated. If the start button 636 has been operated (S12: YES), the start signal is transmitted to the information acquiring mechanism 4 (S13).

Thereafter, whether or not a first completion signal has been received from the information acquiring mechanism 4 is determined (S14). Here, the first completion signal is a signal indicating that the game medium information of all the game media including the convertible game medium 8 arranged in the first arrangement device 2 has been acquired in the information acquiring mechanism 4. If the first completion signal is not received (S14: NO), by re-executing S14, it is in standby state until the first completion signal is received. If the first completion signal has been received (S14: YES), the game medium information in the first arrangement device 2 is acquired from the information acquiring mechanism 4 (S15). Then the acquired game medium information is stored in the first game medium information table of FIG. 8 (S16).

Next, whether or not a second completion signal has been received from the information acquiring mechanism 4 is determined (S17). Here, the second completion signal is a signal indicating that the game medium information of all the game media including the inconvertible game medium 9 arranged in the second arrangement device 3 has been acquired in the information acquiring mechanism 4. If the second completion signal is not received (S17: NO), by re-executing S17, it is in standby state until the second completion signal is received. If the second completion signal has been received (S17: YES), the game medium information in the second arrangement device 3 is acquired from the information acquiring mechanism 4 (S18). And the acquired game medium information is stored in the first game medium information table of FIG. 9 (S19).

(Game Medium Exchange Device: Control Device 5: Information Display Process)

As shown in FIG. 18, when the information display process is executed in the main process, the game medium information is read from the first game medium information table in FIG. 8 (S21). Then, the display color corresponding to the attribute of each piece of game medium information is set based on the display color setting table in FIG. 10 (S22). Thereafter, each piece of game medium information is displayed in the color associated thereto on the left display section 61 in the display device 6 (S23).

Next, the game medium information is read from the second game medium information table in FIG. 9 (S24). Then, the display color corresponding to the attribute of each piece of the game medium information is set based on the display color setting table in FIG. 10 (S25). Thereafter, each piece of game medium information is displayed in the color associated therewith on the right display section 62 in the display device 6 (S26).

As shown in FIG. 12 and FIG. 13, thus, the pieces of game medium information of game media such as the convertible game medium 8 and the inconvertible game medium 9 are displayed on the same screen of the left display section 61 and the right display section 62 simultaneously, and this facilitates the equivalent exchange between the convertible game medium 8 and the inconvertible game medium 9 respectively placed in the first arrangement device 2 and the second arrangement device 3. In addition, the convertible game medium 8 or the inconvertible game medium 9 which is not an exchange object can also be easily found by the game medium information and the display color on the left display section 61 and the right display section 62.

Thereafter, the total amount of each denomination is calculated based on the game medium information of the first and the second game medium information tables (S27). These total amounts are displayed in the denomination amount sections 632*a* of FIG. 11. In addition, the quantity of the game medium of each denomination and the total quantity of all the game media are displayed in the denomination quantity section 631*a* and the total amount section 634*a* respectively (S28).

Thus, by displaying the total amount of each denomination, the quantity of the game medium of each denomination, the total quantity of all the game media, and the quantity of the false recognition, in addition to displaying the pieces of the game medium information of the game media such as the convertible game medium 8 and the inconvertible game medium 9 in the left display section 61 and the right display section 62 on the same screen of simultaneously, the equivalent exchange of the convertible game medium 8 and the inconvertible game medium 9 can be easily performed.

Next, whether or not there is a record of the false recognition in the information acquiring mechanism 4 is determined (S29). If there is no record of the false recognition (S29: NO), the present routine is completed. On the other hand, if there is a record of the false recognition (S29: YES), after displaying the quantity of the false recognition in the error section 633*a* (S30), the present routine is completed.

(Game Medium Exchange Device: Information Acquiring Mechanism 4: Reading Main Process)

Figure 19:
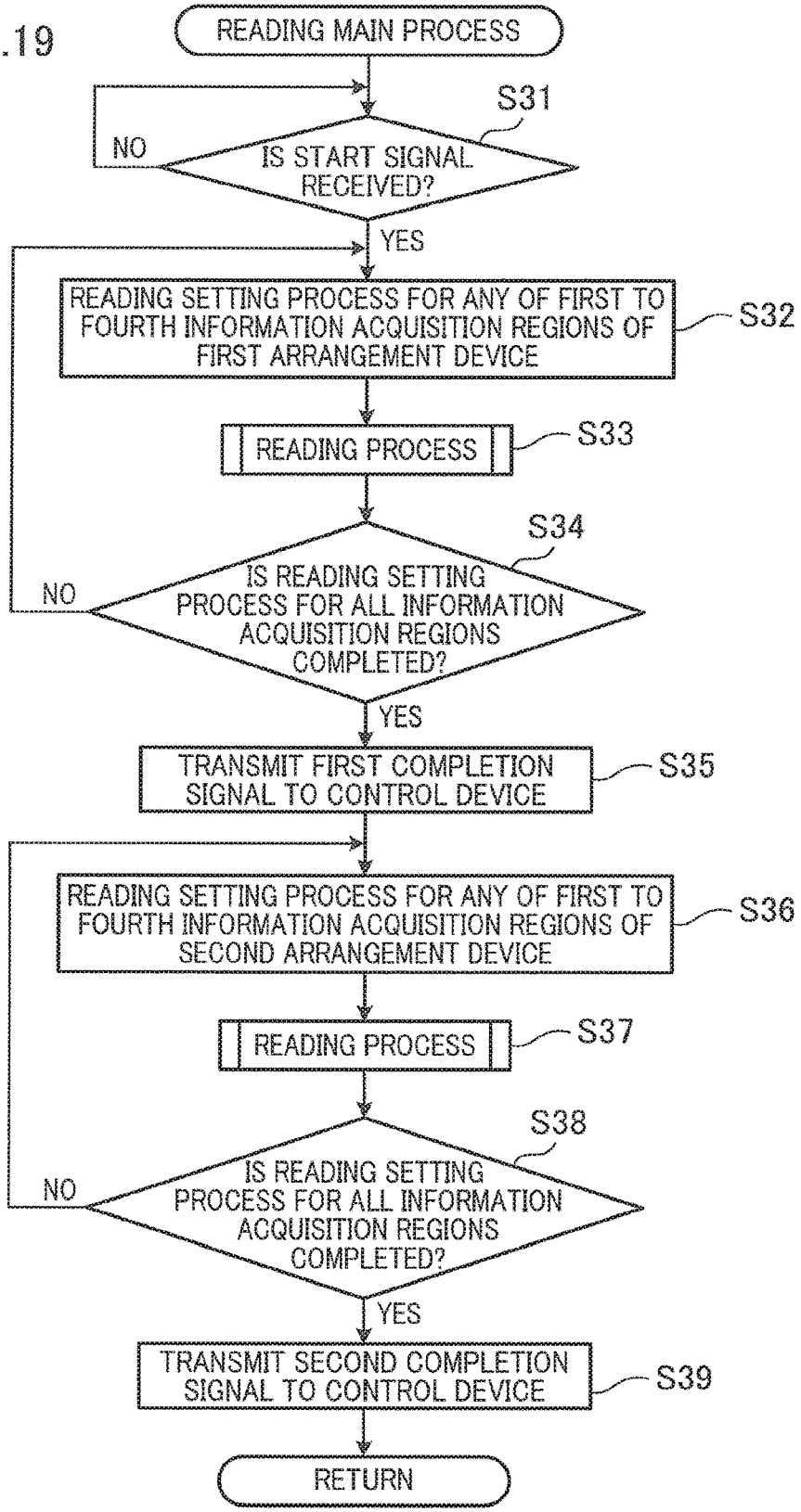
FIG. 19 is a flowchart of a reading main process.

As shown in FIG. 19, in the information acquiring mechanism 4, the main process routine is executed in the control device 5, and various processes are executed. Specifically, first, whether or not the start signal has been received from the control device 5 is determined (S31). If the start signal is not received (S31: NO), by re-executing S31, it is in standby state until the start signal is received (S31). If the start signal has been received (S31: YES), reading setting process is executed to any region of the first to the fourth information acquisition regions 211 to 214 of the first arrangement device 2. That is, a switch circuit of the multiplexer section 47 is set so that the modulation/demodulation section 46 of FIG. 6 is connected to any of the first to the fourth information acquisition regions 211 to 214 (S32).

Thereafter, a reading process for reading the game medium information of all the game media centering on the convertible game medium 8 placed in any region of the first to the fourth information acquisition regions 211 to 214 is executed (S33). Whether or not the reading setting process of all of the first to the fourth information acquisition regions 211 to 214 has been completed is determined (S34). If it is not completed (S34: NO), re-execution from S32 is performed, and a setting for the first to the fourth information acquisition regions 211 to 214 in which the reading setting process has not been set is performed.

When the reading setting process of all of the first to the fourth information acquisition regions 211 to 214 is completed (S34: YES), the first completion signal is transmitted to the control device 5 (S35). With this, the control device 5 acquires and stores the game medium information of all the game media placed in the first arrangement device 2 in the first game medium information table of FIG. 8.

Next, the reading setting process is executed for any region of the first to the fourth information acquisition regions 311 to 314 of the second arrangement device 3. That is, a switch circuit of the multiplexer section 47 is set so that the modulation/demodulation section 46 of FIG. 6 is connected to any of the first to the fourth information acquisition regions 311 to 314 (S36).

Thereafter, a reading process for reading the game medium information of all the game media centering on the inconvertible game medium 9 placed in any region of the first to the fourth information acquisition regions 311 to 314 is executed (S37). Whether or not the reading setting process of all of the first to the fourth information acquisition regions 311 to 314 has been completed is determined (S38). If it is not completed (S38: NO), re-execution from S36 is performed, and a setting for the first to the fourth information acquisition regions 311 to 314 in which the reading setting process has not been set is performed.

When the reading setting process of all of the first to the fourth information acquisition regions 311 to 314 is completed (S38: YES), the second completion signal is transmitted to the control device 5 (S39). With this, the control device 5 acquires and stores the game medium information of all the game media placed in the second arrangement device 3 in the second game medium information table of FIG. 9.

(Game Medium Exchange Device: Information Acquiring Mechanism 4: Reading Process)

Figure 20:
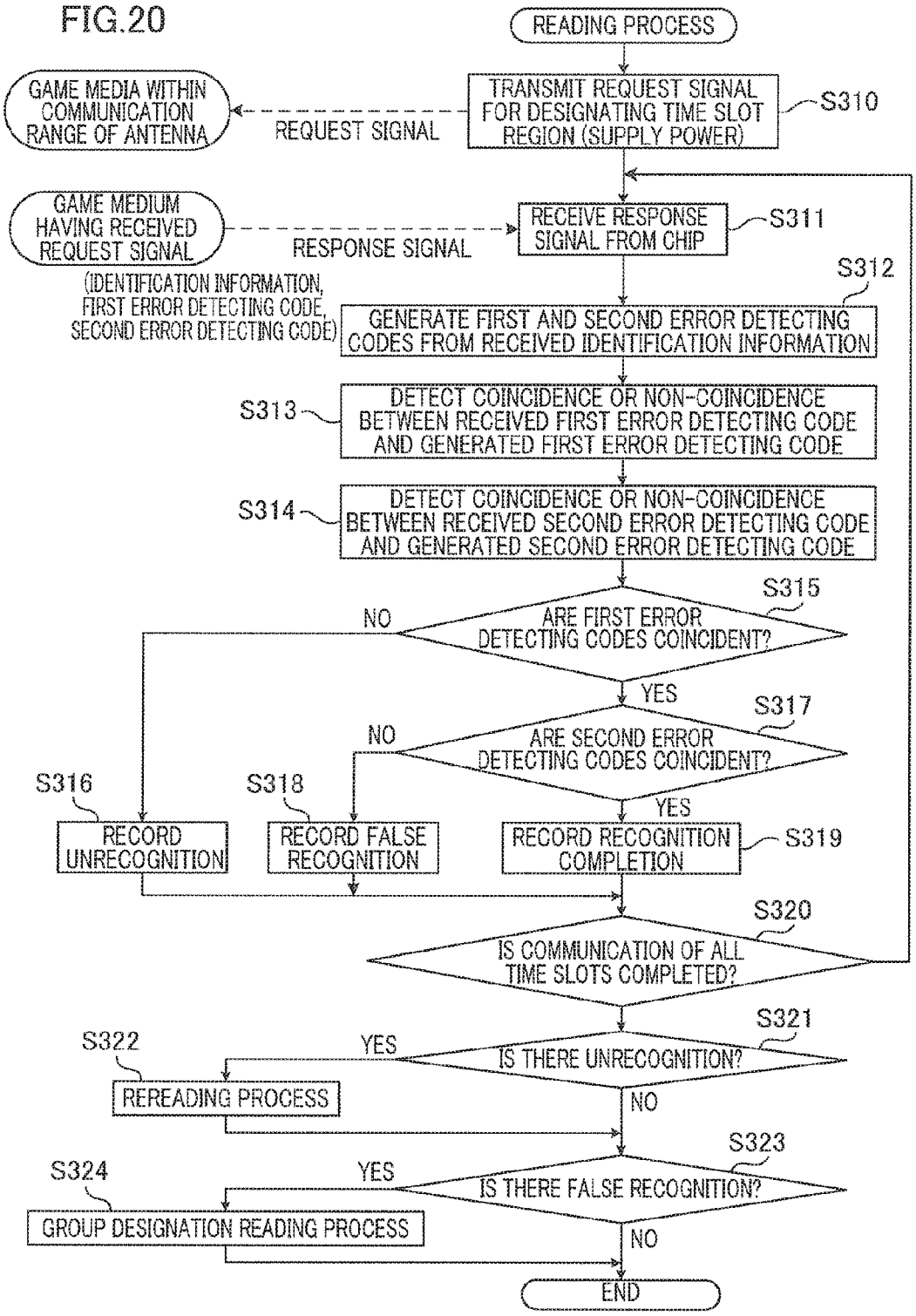
FIG. 20 is a flowchart of a reading process.

As shown in FIG. 20, when the reading process is executed in the information acquiring mechanism 4, through the antenna boards 231 to 233 and 331 to 334 connected via the multiplexer section 47, request signals are transmitted to the RFID tags 101 of the game media 8 and 9 within the communication ranges of the antenna boards 231 to 233 and 331 to 334, and a time slot region is designated (S310).

The RFID tag 101 which has received the request signal generates a 16-bit CRC code by the CRC from the identification information. Next, the RFID tag 101 which has received the request signal, transmits a response signal including the identification information (64-bit UID), the first error detecting code (16-bit CRC code) and the second error detecting code (8-bit DSFID) at timings determined for each value of the time slot region.

The data length of the first error detecting code and the data length of the second error detecting code are shorter than the data length of the identification information. The data length of the second error detecting code is shorter than the data length of the first error detecting code. The first error detecting code and the second error detecting code are generated to have the data lengths different from each other, for example, to differentiate them from each other. The first error detecting code is generated by the RFID tag. The second error detecting code has been generated beforehand and stored in the storage section 43.

When the response signals are received sequentially from each RFID tag 101 via the antenna boards 231 to 233 and 331 to 334 (S311), the first error detecting codes (16-bit UID) and the second error detecting codes (8-bit DSFID) are generated from the identification information in the response signals (S312). Thereafter, a coincidence or non-coincidence between the first error detecting code received from the RFID tag 101 in S311 and the first error detecting code generated in S312 is detected (S313). Usually, if no collision of the response signals occurs, the values of the first error detecting codes are coincident with each other.

After S313, a coincidence or non-coincidence between the second error detecting code received from the RFID tag 101 in S311 and the second error detecting code generated in S312 is detected (S314). Usually, if no collision of the response signals occurs, the values of the second error detecting codes are coincident with each other.

Next, whether or not the first error detecting codes are coincident is determined (S315). Usually, if a collision of the response signal occurs, the first error detecting codes are not coincident, and the RFID tag 101 cannot be recognized. When the response signals are transmitted from a plurality of RFID tags 101 simultaneously, a non-coincidence of the first error detecting codes is detected at S313 due to the change in data value. In this case, it is determined the first error detecting codes are not coincident (S315: NO), and an unrecognition is recorded in the memory 33 as the communication result in the time slot region (S316).

Usually, when the response signals are collided with each other, a non-coincidence of the first error detecting codes is detected in S313. However, even if the response signals are collided with each other, accidentally, the received first error detecting code and the generated first error detecting code may be coincident. The identification information recognized to be correct in this situation is the so-called ghost ID, and the RFID tag 101 recognized to be correct is the so-called ghost game medium.

When a plurality of RFID tags having different identification information, simultaneously, start the communication by using the same time slot with the same spread code, the probability that errors cannot be detected by the n-bit CRC, is the probability that the n-bit CRC code which is generated from the identification information (DATAX) synthesized during reception is accidentally coincident with the n-bit first error detecting code (CRC X) synthesized during reception. This probability can be expressed as $2^{-n}$. In the present embodiment, since the 16-bit CRC code is used as the first error detecting code, ghost chips occur with a probability of $2^{-16}=1/65536$.

In S315, if the first error detecting codes are determined to be coincident (S315: YES), subsequently, whether or not the second error detecting codes are coincident is determined (S317). If the first error detecting codes are coincident and the second error detecting codes are not coincident, a false recognition of the first error detecting codes is generated due to the collision of the response signals. In this case (S317: NO), the false recognition is recorded in the memory 33 as the communication result in the time slot region (S318).

On the other hand, in S317, if it is determined that the first error detecting codes are coincident and the second error detecting codes are coincident, it is determined that a normal recognition of the RFID tags 101 is performed. In this case (S317: YES), recognition completion is recorded in the memory 33 as the communication result in the time slot region (S319).

After the execution of S316, S318 or S319, whether or not the communication of all the time slots within the communication range of each of the antenna boards 231 to 233 and 331 to 334 is completed is determined (S320). If it is determined that the communication of all the time slots is not completed (S320: NO), the process returns to S311. On the other hand, if it is determined that the communication of all the time slots is completed (S320: YES), whether or not there is a record of unrecognition in the memory 33 is determined (S321).

If it is determined there is a record of unrecognition (S321: YES), a rereading process is executed. In the rereading process, a request signal for designating another time slot region (for example, No. 17 to No. 32 bit from the lowest bit in the 64-bit UID) different from the time slot region designated in S310 is transmitted. If it is determined that there is no record of unrecognition in the storage section 43 (S321: NO), or after the process of S322 is executed, whether or not there is a record of false recognition in the storage section 43 is determined (S323). If it is determined that there is no record of false recognition (S324: NO), the present process is completed. On the other hand, if it is determined that there is a record of false recognition (S324: YES), after the group designation reading process is performed (S324), the present process is ended.

To explain the group designation reading process in detail, a designation signal for designating the same time slot region and time slot value as the time slot region and time slot value at the time when the false recognition of the first error detecting code is generated, and designating one group. The designation signal includes a group code, and performs the designation of group by the group code. The number of the groups is the number ($2^n$) of the value that the group code can obtain. In the present embodiment, since the group code is 8-bit, the number of the groups is 256 which are 2 raised to the power of 8. It should be noted that, the present invention is not limited to this example. Only required is that the number of the groups, and the number of the group codes used in the first to the fourth information acquisition regions 211 to 214 and 311 to 314 in the first arrangement device 2 and the second arrangement device 3 are be the same.

The RFID tag 101 that has received the designation signal transmits an answer signal including the group code, the identification information and the first error detecting code. The data length of the group code is shorter than the identification information, the first error detecting code and the second error detecting code. The group codes are previously allocated to each RFID tag 101, and stored in the storage section 43.

Thereafter, the answer signals are received from the RFID tags 101 via the antenna boards 231 to 233 and 331 to 334, and a process of specifying the chip of false recognition is performed. In this process, the first error detecting code is generated from the identification information included in the received designation signal, and recognition of the chip is performed by comparing the generated first error detecting code with the first error detecting code included in the received designation signal. Then, the fact that the recognition with respect to the group has been completed is recorded in the memory 33. The process is performed until the reading of all the groups is completed.

The above embodiments thus described solely serves as specific examples of the present invention, and the present invention is not limited to such examples. Specific configurations of various means may be suitably designed or modified. Further, the effects of the present invention described in the above embodiments are not more than examples of most preferable effects achievable by the present invention. The effects of the present invention are not limited to those described in the embodiments described above.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other configurations, systems, methods or the like are possible, within the spirit of the invention described in the present specification. The description of claims therefore shall encompass configurations equivalent to the present invention, unless otherwise such configurations are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. In the present specification, each process used to derive one result should be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Further, although the present specification occasionally personifies the processes carried out in the steps or blocks, these processes are essentially executed by various devices. Further, the other configurations necessary for the steps or blocks are obvious from the above descriptions.

What is claimed is:

1. A game medium exchange device for exchange between game media each having a currency value, the game medium exchange device comprising:

a display device;

an arranging mechanism comprising a horizontally disposed planar game media arrangement surface configured to receive game media directly thereon, and configured to hold the game media in such a manner that the game media divided into groups are arrangeable relative to each of respective horizontally disposed separate sections of a plurality of horizontally disposed separate sections of the horizontally disposed planar game media arrangement surface;

a plurality of separate horizontally disposed antennas arranged relative to the horizontally disposed planar game media arrangement surface such that each separate antenna is associated with a separate one of each of the plurality of the horizontally disposed separate sections in which the groups of the game media are respectively arrangeable;

an information acquiring mechanism configured to acquire, via each of the separate antennas, game medium information including the currency values of the game media arranged relative to each of the respective horizontally disposed separate sections; and a control device configured to obtain a separate total amount of the currency value acquired by the information acquiring mechanism for each of the plurality of horizontally disposed separate sections, and to display each separate total amount on the display device.

2. The game medium exchange device according to claim 1, wherein, each game medium has a radio frequency identification tag capable of radio communicating the game medium information, the game medium exchange device contains the information acquiring mechanism, and the information acquiring mechanism obtains the game medium information by radio communication with the RFID tag of the game medium placed in the game medium exchange device.

3. The game medium exchanging device of claim 1, wherein the horizontally disposed planar game media arrangement surface comprises a plurality of visibly distinct placing regions that form a plurality of rows and columns.

4. The game medium exchanging device of claim 3, wherein the visibly distinct placing regions are flat relative to the horizontally disposed planar game media arrangement surface.

5. The game medium exchanging device of claim 3, wherein each of the visibly distinct placing regions comprises a recessed portion that is recessed relative to the horizontally disposed planar game media arrangement surface.

6. The game medium exchanging device of claim 3, wherein each of the visibly distinct placing regions comprises partitioning lines configured to receive a differently sized game media.

7. The game medium exchanging device of claim 6, wherein each of the visibly distinct placing regions includes a center-point configured to receive a center-point of the differently sized game media thereover.

8. The game medium exchanging device of claim 3, wherein each separate antenna for each of the plurality of horizontally disposed separate sections is disposed below the horizontally disposed planar game media arrangement surface.

9. The game medium exchanging device of claim 8, wherein a communications range of each of the plurality of antennas associated with each of the plurality of horizontally disposed separate sections, is limited to that horizontally disposed separate section with which it is associated.

10. A game medium exchange device for exchange between game media each having a currency value, the game medium exchange device comprising:

a display device;

an arranging mechanism comprising a horizontally disposed planar game media arrangement surface configured to receive game media directly thereon, and configured to hold the game media in such a manner that the game media divided into groups are arrangeable relative to each of respective horizontally disposed separate sections of a plurality of horizontally disposed separate sections of the game media arrangement surface;

a plurality of separate horizontally disposed antennas arranged relative to the horizontally disposed planar game media arrangement surface such that each separate antenna is associated with a separate one of each of the plurality of the horizontally disposed separate sections;

an information acquiring mechanism configured to acquire game medium information including the currency values of the game media arranged relative to each of the respective horizontally disposed separate sections; and a control device configured to obtain a separate total amount of the currency value acquired by the information acquiring mechanism for each of the plurality of horizontally disposed separate sections, and to display each separate total amount on the display device, wherein, the game media include a convertible game medium exchangeable for currency, and an inconvertible game medium unexchangeable for currency, and, the control device displays the separate total amounts of the currency value on the display device in association with the convertible game medium and the inconvertible game medium.

11. The game medium exchange device according to claim 10, wherein, each game medium has a radio frequency identification tag capable of radio communicating the game medium information, the game medium exchange device contains the information acquiring mechanism, and the information acquiring mechanism obtains the game medium information by radio communication with the RFID tag of the game medium placed in the game medium exchange device.

12. A game medium exchange device for exchange between game media each having a currency value, the game medium exchange device comprising:

a display device;

an arranging mechanism comprising a horizontally disposed planar game media arrangement surface configured to receive game media directly thereon, and configured to hold the game media in such a manner that the game media divided into groups are arrangeable relative to each of respective horizontally disposed separate sections of a plurality of horizontally disposed sections of the horizontally disposed planar game media arrangement surface;

a plurality of separate horizontally disposed antennas arranged relative to the horizontally disposed planar game media arrangement surface such that each separate antenna is associated with a separate one of each of the plurality of the horizontally disposed separate sections in which the groups of the game media are respectively arrangeable;

an information acquiring mechanism configured to acquire, via each of the separate antennas, game medium information including the currency values of the game media arranged relative to each of the respective horizontally disposed separate sections; and a control device configured to obtain a separate total amount of the currency value acquired by the information acquiring mechanism for each of the plurality of horizontally disposed separate sections, and to display each separate total amount on the display device, wherein, the control device identifies a currency unit of each currency value based on the game medium information acquired by the information acquiring mechanism, assigns a corresponding separate color for each identified currency unit, and displays to the display device each respective currency unit of each currency value according to its assigned corresponding currency unit color.

13. The game medium exchange device according to claim 12, wherein, each game medium has a radio frequency identification tag capable of radio communicating the game medium information, the game medium exchange device contains the information acquiring mechanism, and the information acquiring mechanism obtains the game medium information by radio communication with the RFID tag of the game medium placed in the game medium exchange device.

14. A game medium exchange device for exchange between game media each having a currency value, the game medium exchange device comprising:

a display device;

an arranging mechanism comprising a horizontally disposed planar game media arrangement surface configured to receive game media directly thereon, and configured to hold the game media in such a manner that the game media divided into groups are arrangeable relative to each of respective horizontally disposed separate sections of a plurality of horizontally disposed sections of the horizontally disposed planar game media arrangement surface;

a plurality of separate horizontally disposed antennas arranged relative to the horizontally disposed planar game media arrangement surface such that each separate antenna is associated with a separate one of each of the plurality of the horizontally disposed separate sections;

an information acquiring mechanism configured to acquire game medium information including the currency values of the game media arranged relative to each of the respective horizontally disposed separate sections; and a control device configured to obtain a separate total amount of the currency value acquired by the information acquiring mechanism for each of the plurality of horizontally disposed separate sections, and to display each separate total amount on the display device, wherein, the control device identifies a type of each game medium based on the game medium information acquired by the information acquiring mechanism, assigns a corresponding separate color for each type of game medium, and displays to the display device each respective game medium type according to its assigned corresponding color.

15. The game medium exchange device according to claim 14, wherein, each game medium has a radio frequency identification tag capable of radio communicating the game medium information, the game medium exchange device contains the information acquiring mechanism, and the information acquiring mechanism obtains the game medium information by radio communication with the RFID tag of the game medium placed in the game medium exchange device.

* * * * *